US009683465B2

(12) United States Patent
Tadokoro et al.

(10) Patent No.: US 9,683,465 B2
(45) Date of Patent: Jun. 20, 2017

(54) VALVE-TIMING CONTROL APPARATUS FOR INTERNAL COMBUSTION ENGINE

(71) Applicant: HITACHI AUTOMOTIVE SYSTEMS, LTD, Hitachinaka-shi, Ibaraki (JP)

(72) Inventors: Ryo Tadokoro, Hadano (JP); Seiichi Sue, Atsugi (JP); Shinichi Kawada, Isehara (JP); Hiroyuki Nemoto, Hitachi (JP); Isao Doi, Isehara (JP)

(73) Assignee: HITACHI AUTOMOTIVE SYSTEMS, LTD., Hitachinaka-Shi (JP)

( * ) Notice: Subject to any disclaimer, the term of this patent is extended or adjusted under 35 U.S.C. 154(b) by 203 days.

(21) Appl. No.: 14/725,541

(22) Filed: May 29, 2015

(65) Prior Publication Data

US 2015/0345346 A1 Dec. 3, 2015

(30) Foreign Application Priority Data

Jun. 3, 2014 (JP) ..... 2014-114472

(51) Int. Cl.

| | |
|---|---|
| ***F01L 1/34*** | (2006.01) |
| ***F01L 1/344*** | (2006.01) |
| ***F01L 1/047*** | (2006.01) |
| ***F01L 25/08*** | (2006.01) |

(52) U.S. Cl.

CPC ..... *F01L 1/344* (2013.01); *F01L 1/047* (2013.01); *F01L 25/08* (2013.01)

(58) Field of Classification Search

CPC ..... F01L 1/344; F01L 1/047; F01L 25/08
USPC ..... 123/90.17
See application file for complete search history.

(56) References Cited

U.S. PATENT DOCUMENTS 7,624,710 B2 * 12/2009 Uehama ..... F01L 1/352 123/90.15

FOREIGN PATENT DOCUMENTS

JP 2012-132367 A 7/2012

* cited by examiner

*Primary Examiner* — Zelalem Eshete
(74) *Attorney, Agent, or Firm* — Foley & Lardner LLP

(57) ABSTRACT

A valve-timing control apparatus varies a relative phase between a cam shaft and a crankshaft by energizing an electric motor through a power-feeding brush provided to be in contact with a slip ring. The valve-timing control apparatus includes a retaining member slidably retaining the power-feeding brush; a connector provided in the retaining member and connected to a power source; a pigtail harness including one end portion connected with the power-feeding brush, and another end portion connected with a terminal of the connector through a fixing portion; and a guide portion provided in the retaining member and including an outer circumferential surface formed in an arc-shape. The pigtail harness bends along the outer circumferential surface of the guide portion. The another end portion extends substantially in a linear arrangement from the fixing portion to a bending portion at which the pigtail harness bends along the outer circumferential surface.

16 Claims, 13 Drawing Sheets

VALVE-TIMING CONTROL APPARATUS FOR INTERNAL COMBUSTION ENGINE

BACKGROUND OF THE INVENTION

The present invention relates to a valve-timing control apparatus for an internal combustion engine, in which opening and closing timings of an intake valve and/or an exhaust valve are controlled.

Japanese Patent Application Publication No. 2012-132367 discloses a previously-proposed valve-timing control apparatus for an internal combustion engine.

In this technique, a cover member is provided on a front end side of a motor housing for an electric motor. A retaining member that slidably retains a pair of power-feeding brushes is attached to the cover member. Each of the pair of power-feeding brushes includes a backend portion which is connected through a pigtail harness to a connector terminal of a power-source connector, and a tip portion which is elastically in contact with a slip ring by biasing force of a coil spring to be slidable on the slip ring.

Electric current supplied through the pigtail harness and the power-source connector from a battery is applied through the power-feeding brush, the slip ring, a switching brush and a commutator to a coil of the electric motor. Accordingly, an output shaft of the electric motor is drivingly rotated.

Rotational driving force of the electric motor is transmitted through a speed-reduction mechanism to a cam shaft so that a relative rotational phase between the cam shaft and a timing sprocket is changed. Thus, the opening and closing timings of the intake valve and/or exhaust valve are controlled.

SUMMARY OF THE INVENTION

However, in the case of the previously-proposed valve-timing control apparatus, relatively large vibrations are caused by alternating torque generated in the cam shaft due to biasing force of a valve spring of each intake valve and the like. These relatively large vibrations are transmitted through the slip ring and the power-feeding brush to the pigtail harness.

The relatively large vibrations transmitted to the pigtail harness cause a concentrated stress (stress concentration) at a connecting spot (e.g., soldered spot) between the connector terminal and an end portion of the pigtail harness. In such a case, there is a possibility that a faulty electrical connection at the connecting spot occurs so that a durability thereof is reduced.

It is therefore an object of the present invention to provide a valve-timing control apparatus for an internal combustion engine, devised to suppress the concentrated stress that is caused at the connecting spot between the connector terminal and the pigtail harness.

According to one aspect of the present invention, there is provided a valve-timing control apparatus for an internal combustion engine, wherein the valve-timing control apparatus is configured to vary a relative phase between a rotation of a cam shaft and a rotation of a crankshaft by energizing an electric motor through a power-feeding brush provided to be in contact with a slip ring, the valve-timing control apparatus comprising: a retaining member slidably retaining the power-feeding brush; a connector provided in the retaining member and connected to a power source; a pigtail harness including one end portion connected with the power-feeding brush, and another end portion connected with a terminal of the connector through a fixing portion of the another end portion; and a guide portion provided in the retaining member and including an outer circumferential surface formed in an arc-shape, wherein the pigtail harness bends along the outer circumferential surface of the guide portion, and the another end portion extends substantially in a linear arrangement from the fixing portion to a bending portion at which the pigtail harness bends along the outer circumferential surface.

According to another aspect of the present invention, there is provided a valve-timing control apparatus for an internal combustion engine, wherein the valve-timing control apparatus is configured to vary a relative phase between a rotation of a cam shaft and a rotation of a crankshaft by energizing an electric motor through a power-feeding brush provided to be in contact with a slip ring, the valve-timing control apparatus comprising: a retaining member slidably retaining the power-feeding brush; a connector provided in the retaining member and connected to a power source; a conducting wire including one end portion connected with the power-feeding brush, and another end portion connected with a terminal of the connector through a fixing portion of the another end portion; and a guide portion provided in the retaining member and including an outer circumferential surface formed in an arc-shape, wherein the conducting wire bends at an obtuse angle around the outer circumferential surface of the guide portion, and the fixing portion is away by a predetermined distance from a bending portion at which the conducting wire bends around the outer circumferential surface.

The other objects and features of this invention will become understood from the following description with reference to the accompanying drawings.

DETAILED DESCRIPTION OF THE INVENTION

Figure 1:
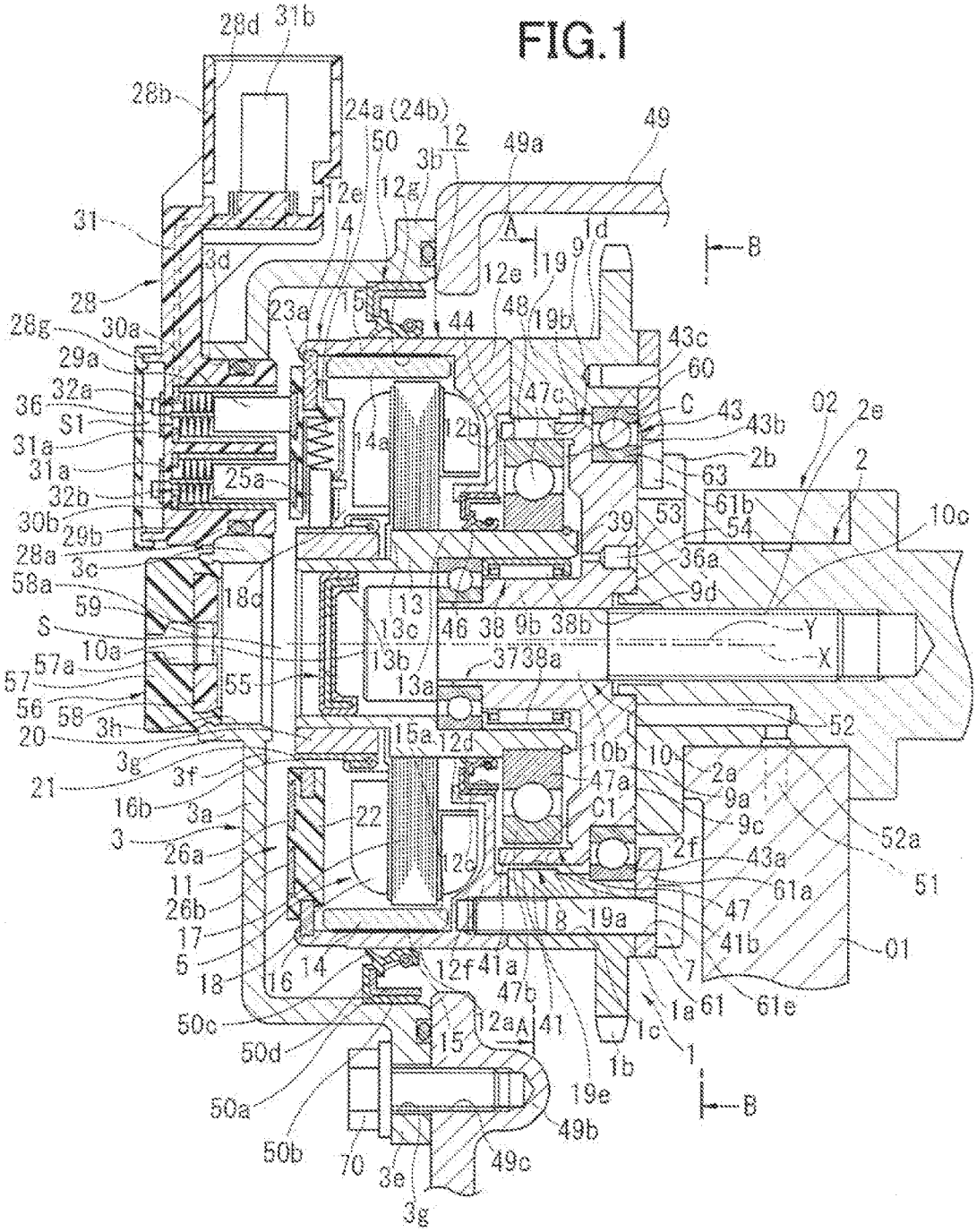
FIG. 1 is a longitudinal sectional view of a valve-timing control apparatus in a first embodiment according to the present invention.

Reference will hereinafter be made to the drawings in order to facilitate a better understanding of the present invention. Hereinafter, embodiments of valve-timing control apparatus for an internal combustion engine according to the present invention will be explained referring to the drawings. In the following embodiments, the valve-timing control apparatus according to the present invention is applied to an intake side of the internal combustion engine.

Figure 2:
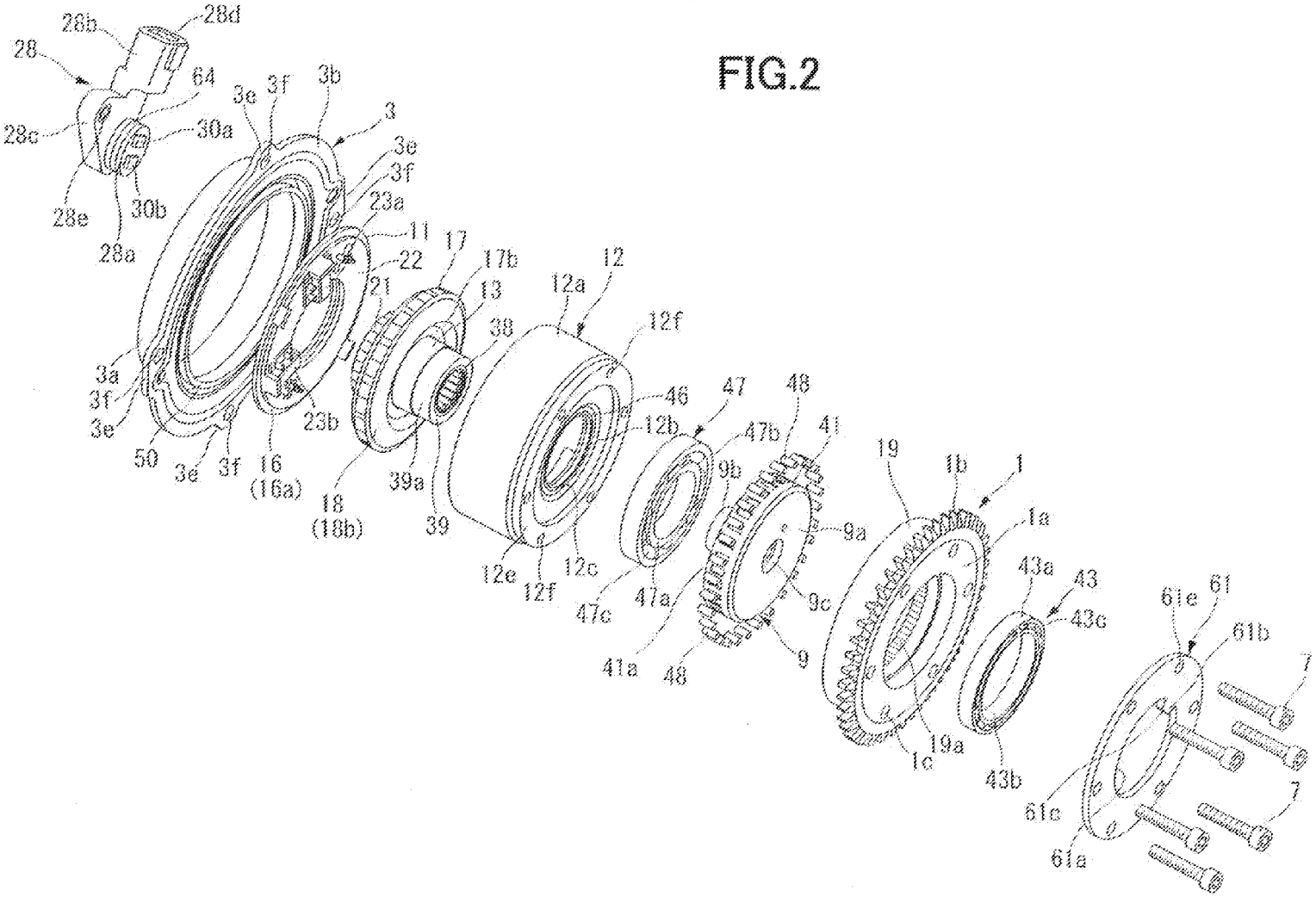
FIG. 2 is an exploded oblique perspective view showing structural elements in the first embodiment.

As shown in FIGS. 1 and 2, a valve-timing control apparatus includes a timing sprocket 1, a cam shaft 2, a cover member 3 and a phase change mechanism 4. The timing sprocket 1 (functioning as a drive rotating member) is rotated and driven by a crankshaft of the internal combustion engine. The cam shaft 2 is rotatably supported on a cylinder head 01 through a bearing 02, and is rotated by a rotational force transmitted from the timing sprocket 1. The cover member 3 is provided on a front side (in an axially frontward direction) of the timing sprocket 1, and is fixedly attached to a chain cover 49. The phase change mechanism 4 is provided between the timing sprocket 1 and the cam shaft 2, and is configured to change a relative rotational phase between the timing sprocket 1 and the cam shaft 2 in accordance with an operating state of the engine.

Whole of the timing sprocket 1 is integrally formed of an iron-based metal in an annular shape. The timing sprocket 1 includes a sprocket main body 1*a*, a gear portion 1*b* and an internal-teeth constituting portion (internal-gear portion) 19. An inner circumferential surface of the sprocket main body 1*a* is formed in a stepped shape to have two relatively large and small diameters as shown in FIG. 1. The gear portion 1*b* is formed integrally with an outer circumference of the sprocket main body 1*a*, and receives rotational force through a wound timing chain (not shown) from the crankshaft. The internal-teeth constituting portion 19 is formed integrally with a front end portion of the sprocket main body 1*a*.

A large-diameter ball bearing 43 which is a bearing having a relatively large diameter is interposed between the sprocket main body 1*a* and an after-mentioned follower member 9 provided on a front end portion of the cam shaft 2. The timing sprocket 1 is rotatably supported by the cam shaft 2 through the large-diameter ball bearing 43 such that a relative rotation between the cam shaft 2 and the timing sprocket 1 is possible.

The large-diameter ball bearing 43 includes an outer race 43*a*, an inner race 43*b*, and a ball(s) 43*c* interposed between the outer race 43*a* and the inner race 43*b*. The outer race 43*a* of the large-diameter ball bearing 43 is fixed to an inner circumferential portion (i.e., inner circumferential surface) of the sprocket main body 1*a* whereas the inner race 43*b* of the large-diameter ball bearing 43 is fixed to an outer circumferential portion (i.e., outer circumferential surface) of the follower member 9.

The inner circumferential portion of the sprocket main body 1*a* is formed with an outer-race fixing portion 60 which is in an annular-groove shape as obtained by cutting out a part of the inner circumferential portion of the sprocket main body 1*a*. The outer-race fixing portion 60 is formed to be open toward the cam shaft 2. The outer-race fixing portion 60 is formed in a stepped shape to have two relatively large and small diameters. The outer race 43*a* of the large-diameter ball bearing 43 is fitted into the outer-race fixing portion 60 by press fitting in an axial direction of the timing sprocket 1. Thereby, one axial end of the outer race 43*a* is placed at a predetermined position, that is, a positioning of the outer race 43*a* is performed.

The internal-teeth constituting portion 19 is formed integrally with an outer circumferential side of the front end portion of the sprocket main body 1*a*. The internal-teeth constituting portion 19 is formed in a cylindrical shape (circular-tube shape) extending in a frontward direction of the phase change mechanism 4. An inner circumference of the internal-teeth constituting portion 19 is formed with internal teeth (internal gear) 19*a* which function as a wave-shaped meshing portion.

Moreover, a female-thread constituting portion 12*e* formed integrally with an after-mentioned motor housing 12 is placed to face a front end portion of the internal-teeth constituting portion 19. The female-thread constituting portion 12*e* is formed in an annular shape.

Moreover, an annular retaining plate 61 is disposed on a (axially) rear end portion of the sprocket main body 1*a*, on the side opposite to the internal-teeth constituting portion 19. This retaining plate 61 is integrally formed of metallic sheet material. As shown in FIG. 1, an outer diameter of the retaining plate 61 is approximately equal to an outer diameter of the sprocket main body 1*a*. An inner diameter of the retaining plate 61 is smaller than an inner diameter of the outer race 43*a* of the large-diameter ball hearing 43.

An inner circumferential portion 61*a* of the retaining plate 61 is in contact with an axially outer end surface of the outer race 43*a*. Moreover, a stopper convex portion 61*b* which protrudes in a radially-inner direction of the annular retaining plate 61, i.e. protrudes toward a central axis of the annular retaining plate 61 is provided at a predetermined location of an inner circumferential edge (i.e., radially-inner edge) of the inner circumferential portion 61*a*. This stopper convex portion 61*b* is formed integrally with the inner circumferential portion 61*a*.

Figure 4:
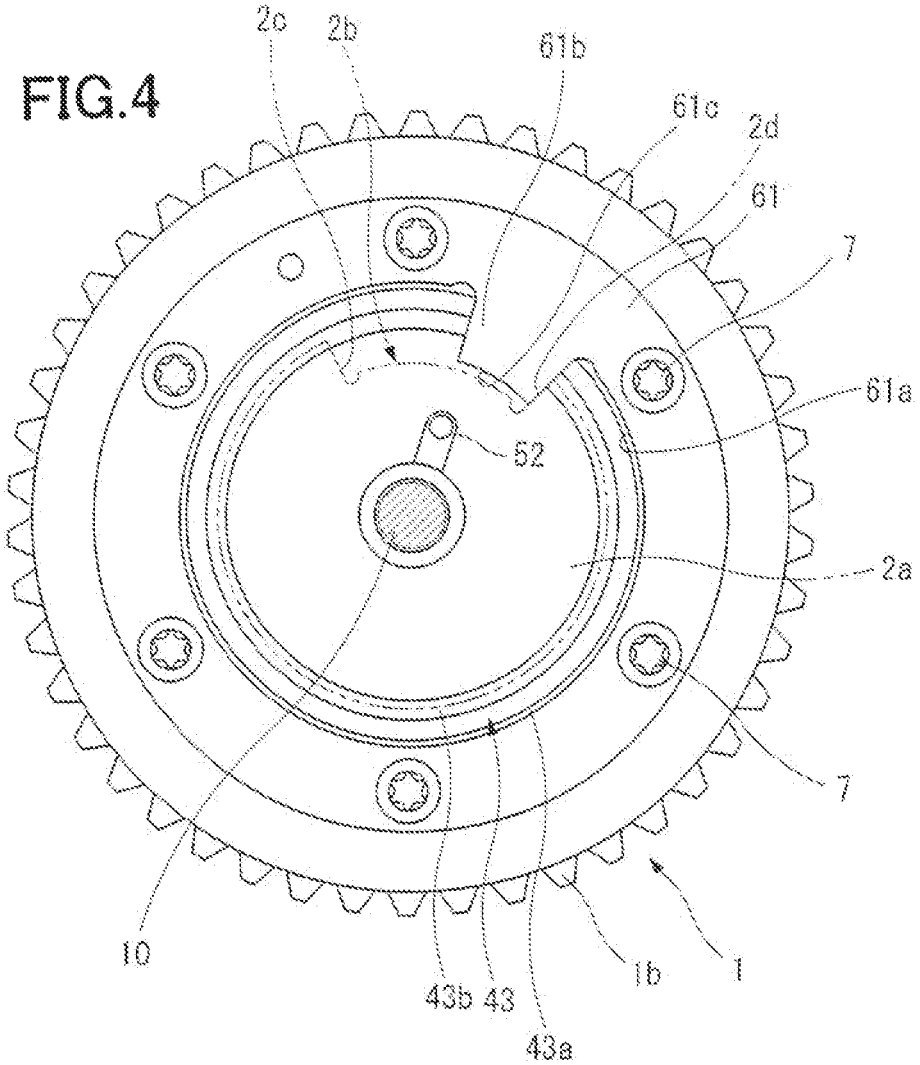
FIG. 4 is a sectional view of FIG. 1, taken along a line B-B.

As shown in FIGS. 1 and 4, the stopper convex portion 61*b* is formed in a substantially fan shape. A tip edge 61*c* of the stopper convex portion 61*b* is formed in a circular-arc shape in cross section, along a circular-arc-shaped inner circumferential surface of an after-mentioned stopper groove 2*b*.

An outer circumferential portion of the sprocket main body 1*a* (the internal-teeth constituting portion 19) is formed with six bolt insertion holes 1*c* each of which axially passes through the timing sprocket 1*a*. The six bolt insertion holes 1*c* are formed substantially at circumferentially equally-spaced intervals in the outer circumferential portion of the sprocket main body 1*a*. Moreover, the female-thread constituting portion 12*e* is formed with six female threaded holes 12*f* at its portions respectively corresponding to the six bolt insertion holes 1*c* and the six bolt insertion holes 61*e*. By the six bolts 7 inserted into the six bolt insertion holes 61*e*, the six bolt insertion holes 1*c* and the six female threaded holes 12*f*; the timing sprocket 1*a*, the retaining plate 61 and the motor housing 12 are jointly fastened to one another from the axial direction.

It is noted that the sprocket main body 1*a* and the internal-teeth constituting portion 19 function as a casing for an after-mentioned speed-reduction mechanism 8.

The timing sprocket 1*a*, the internal-teeth constituting portion 19, the retaining plate 61 and the female-thread constituting portion 12*e* have outer diameters substantially equal to one another.

As shown in FIG. 1, the chain cover 49 is fixed to a front end portion of a cylinder block (not shown) and the cylinder head 01 which constitute a main body of the engine. The chain cover 49 is disposed along an upper-lower direction to cover a chain (not shown) wound around the timing sprocket 1*a*. The chain cover 49 is formed with an opening portion at a location corresponding to the phase change mechanism 4. An annular wall 49*a* constituting the opening portion of the chain cover 49 is formed with four boss portions 49*b*. The four boss portions 49*b* are formed integrally with the annular wall 49*a* and are located at circumferential four spots of the annular wall 49*a*. A female threaded hole 49*c* is formed in the annular wall 49*a* and each boss portion 49*b* to pass through the annular wall 49*a* and reach an interior of the each boss portion 49*b*. That is, four female threaded holes 49*c* corresponding to the four boss portions 49*b* are formed.

As shown in FIGS. 1 and 2, the cover member 3 is made of aluminum ahoy material and is integrally formed in a cup shape. The cover member 3 is provided to face and cover a front end portion of the motor housing 12. The cover member 3 includes a cover main body 3*a* and a mounting flange 3*b*. The cover main body 3*a* bulges out in the cup shape (protrudes in an expanded state) frontward in the axial direction. The mounting flange 3*b* is in an annular shape (ring shape) and is formed integrally with an outer circumferential edge of an opening-side portion of the cover main body 3*a*. Moreover, a cup-shaped space portion S is separately formed between an inner surface 3*f* of the cover member 3 and an outer surface of the front end portion of the motor housing 12.

The cover main body 3*a* includes a cylindrical wall 3*c* at a radially outer portion of the cup-shaped cover main body 3*a*. The cylindrical wall 3*c* is formed integrally with the cover main body 3*a* to protrude in the axial direction. A retention hole 3*d* is formed in the cylindrical wall 3*c* and passes through the cylindrical wall 3*c* in the axial direction.

Moreover, the cover main body 3*a* includes a cylindrical portion 3*g* on a lower side (in FIG. 1) of the cylindrical wall 3*c*, i.e. at a radially central portion of the cup-shaped cover main body 3*a*. The cylindrical portion 3*g* is formed integrally with the cover main body 3*a* to protrude in the axial direction and in parallel with the cylindrical wall 3*c*. An upper end portion of the cylindrical portion 3*g* (in FIG. 1), i.e. a radially-outer end portion of the cylindrical portion 3*g* is integrally formed with a lower end portion of the cylindrical wall 3*c* (in FIG. 1). A communication hole 3*h* is formed in the cylindrical portion 3*g* and passes through the cylindrical portion 3*g* in the axial direction. The communication hole 3*h* communicates the space portion S with an outside of the cover main body 3*a*. For purpose of air ventilation, a plug member 56 is fixedly fitted into an outer end portion of the communication hole 3*h* by press fitting.

The communication hole 3*h* (the cylindrical portion 3*g*) functions as a hole through which a cam bolt 10 is inserted into a motor output shaft 13 after the cover member 3 has been attached to the chain cover 49. The cam bolt 10 is used for fastening the follower member 9 to the cam shaft 2.

As shown in FIG. 1, the plug member 56 includes a main body 57, a support portion 58 and a circular filter 59. The main body 57 is made of synthetic resin, and is in an annular shape having its bottom. The support portion 58 is formed in a circular-disc shape, and is fitted into a concave groove formed in a rear end surface (i.e., a cam-shaft-side surface) of the main body 57, by press fitting. The circular filter 59 is placed on a bottom surface of the concave groove such that the circular filter 59 is held between the bottom surface of the concave groove and the support portion 58 in a sandwiched state.

Moreover, a first ventilating hole 57*a* is formed in the main body 57 such that the first ventilating hole 57*a* communicates a center portion of the bottom surface of the concave groove of the main body 57 with an outside of the cover member 3. A second ventilating hole 58*a* is formed in a center portion of the support portion 58 to pass through the support portion 58 in the axial direction. Hence, the second ventilating hole 58*a* is open to the first ventilating hole 57*a*.

The filter 59 is like a thin cloth having a circular-disc shape, and is flexible with high degree of freedom. Whole of the filter 59 adheres to the bottom surface of the concave groove of the main body 57. The filter 59 is made of a base material which permits air to penetrate the filter 59 from the support portion 58 toward the bottom surface of the concave groove of the main body 57, i.e. from one surface of the filter 59 located on the support portion 58 toward another surface of the filter 59 located on the bottom surface of the concave groove. Moreover, the filter 59 blocks liquid, dust and the like from penetrating the filter 59 from the another surface of the filter 59 toward the one surface of the filter 59.

The mounting flange 3*b* includes four boss portions 3*e*, also as shown in FIG. 2. The four boss portions 3*e* are formed substantially at circumferentially equally-spaced intervals (approximately at every 90-degree location) on the mounting flange 3*b*. As shown in FIG. 1, each boss portion 3*e* is formed with a bolt insertion hole 3*f*. The bolt insertion hole 3*f* passes through the boss portion 3*e*. Each bolt 70 is inserted through the bolt insertion hole 3*f* and is screwed in the female threaded hole 49*c* formed in the chain cover 49. By these bolts 70, the cover member 3 is fixed to the chain cover 49.

As shown in FIG. 1, an oil seal 50 which is a seal member having a large diameter is interposed between an outer circumferential surface of the motor housing 12 and an inner circumferential surface of a stepped portion (multilevel portion) of outer circumferential side of the cover main body 3*a*. The large-diameter oil seal 50 is formed in a substantially U-shape in cross section such that a core metal 50*a* is buried inside a base material formed of synthetic rubber, as shown in FIG. 1. An annular base portion 50*b* of outer circumferential side of the large-diameter oil seal 50 is fixedly fitted into a bottom surface of an annular groove formed in the inner circumferential surface of the cover member 3, by press fitting. The large-diameter oil seal 50 further includes a sealing portion 50*c* located on an inner circumferential side of the annular base portion 50*b*. The sealing portion 50*c* has a seal lip, and is formed integrally with the annular base portion 50*b*. This sealing portion 50*c* is elastically in contact with an outer circumferential surface of an after-mentioned housing main body 12*a* by spring force of a backup spring 50*d*, so that the large-diameter oil seal 50 realizes its sealing function. That is, the large-diameter oil seal 50 liquid-tightly seals the space portion S which exists inside an electric motor 5 such that lubricating oil scattered mainly due to the rotational drive of the timing sprocket 1 is prevented from entering the space portion S.

The cam shaft 2 includes two drive cams per one cylinder of the engine. Each drive cam is provided on an outer circumference of the cam shaft 2, and functions to open an intake valve (not shown). The front end portion of the cam shaft 2 is formed integrally with a flange portion 2*a*. A female threaded hole 2*e* is formed (drilled) in an axially one end portion of the cam shaft 2 which includes a location of the flange portion 2*a*. A male threaded portion 10*c* formed in a tip portion of a shaft portion 10*b* of the cam bolt 10 is screwed into the female threaded hole 2*e*.

As shown in FIG. 1, an outer diameter of the flange portion 2*a* is designed to be slightly larger than an outer diameter of an after-mentioned fixing end portion 9*a* of the follower member 9. An outer circumferential portion of a front end surface 2*f* of the flange portion 2*a* is in contact with an axially outer end surface of the inner race 43*b* of the large-diameter ball bearing 43, after an assembly of respective structural components.

The front end surface 2*f* of the flange portion 2*a* is fixedly connected with the follower member 9 from the axial direction by a cam bolt 10 under a state where the front end surface 2*f* of the flange portion 2*a* is in contact with a rear end surface 9*c* of an after-mentioned fixing end portion 9*a* of the follower member 9 in the axial direction.

As shown in FIG. 4, an outer circumference of the flange portion 2*a* is formed with a stopper concave groove 2*b* into which the stopper convex portion 61*b* of the retaining plate 61 is inserted and engaged. The stopper concave groove 2*b* is formed along a circumferential direction of the flange portion 2*a*. (A bottom surface of) The stopper concave groove 2*b* is formed in a circular-arc shape in cross section when taken by a plane perpendicular to the axial direction of the cam shaft 2. The stopper concave groove 2*b* is formed in an outer circumferential surface of the flange portion 2*a* within a predetermined range given in a circumferential direction of the cam shaft 2. The cam shaft 2 rotates within this circumferential range relative to the sprocket main body 1*a* so that one of both end edges of the stopper convex portion 61*b* becomes in contact with the corresponding one of circumferentially-opposed edges 2*c* and 2*d* of the stopper concave groove 2*b*. Thereby, a relative rotational position of the cam shaft 2 to the timing sprocket 1 is restricted between a maximum advanced side and a maximum retarded side.

As shown in FIG. 1, the cam bolt 10 includes a head portion 10*a* and a shaft portion 10*b*. An end surface of the head portion 10*a* which is located on the side of the shaft portion 10*b* supports an inner race of a small-diameter ball bearing 37 in the radial direction of the cam bolt 10. An outer circumference of the tip portion of the shaft portion 10*b* includes the male threaded portion 10*c*.

The follower member 9 which functions as a driven rotating member is integrally formed of an iron-based metal. As shown in FIG. 1, the follower member 9 includes the fixing end portion 9*a*, a cylindrical portion (circular tube portion) 9*b* and a cylindrical retainer (retaining member) 41. The fixing end portion 9*a* is in a circular-plate shape and is formed in a rear end side (a cam-shaft-side portion) of the follower member 9. The cylindrical portion 9*b* protrudes in the axial direction from a front end of an inner circumferential portion of the fixing end portion 9*a*. The retainer 41 is formed integrally with an outer circumferential portion of the fixing end portion 9*a*, and retains or guides a plurality of rollers (rolling elements) 48.

A rear end surface 9*c* of the fixing end portion 9*a* is in contact with the front end surface 2*f* of the flange portion 2*a* of the cam shaft 2. The fixing end portion 9*a* is pressed and fixed to the flange portion 2*a* in the axial direction by an axial force of the cam bolt 10.

As shown in FIG. 1, the cylindrical portion 9*b* and the fixing end portion 9*a* are formed with a bolt insertion hole (cam-bolt insertion hole) 9*d* which passes through a center of the cylindrical portion 9*b* and a center of the fixing end portion 9*a* in the axial direction. The shaft portion 10*b* of the cam bolt 10 is passed through the insertion hole 9*d*. Moreover, a needle bearing 38 which functions as a bearing member is provided on an outer circumferential surface of the cylindrical portion 9*b*.

As shown in FIG. 1, the retainer 41 is formed in a cylindrical shape (circular-tube shape) having its bottom and protruding from the bottom in the extending direction of the cylindrical portion 9*b*. The retainer 41 is forwardly bent in a substantially L-shape in cross section from a front end of the outer circumferential portion of the fixing end portion 9*a*.

A tubular tip portion 41*a* of the retainer 41 extends and exits through an accommodating space 44 toward a dividing wall 12*b* of the motor housing 12. The accommodating space 44 is formed in an annular concave shape between the female-thread constituting portion 12*e* and the dividing wall 12*b*. Moreover, as shown in FIGS. 1 and 2, a plurality of roller-retaining holes 41*b* are formed in the tubular tip portion 41*a* by cutting substantially at circumferentially equally-spaced intervals. Each of the plurality of roller-retaining holes 41*b* is formed in a substantially rectangular shape in cross section, and retains the roller 48 to allow a rolling movement of the roller 48. The total number of the roller-retaining holes 41*b* (or the total number of the rollers 48) is smaller than the total number of the internal teeth 19*a* of the internal-teeth constituting portion 19. Accordingly, a speed reduction ratio can be obtained.

The phase change mechanism 4 mainly includes an electric motor 5 and the speed-reduction mechanism 8. The electric motor 5 is disposed on a front end side of the cylindrical portion 9*b* of the follower member 9. The speed-reduction mechanism 8 functions to reduce a rotational speed of the electric motor 5 and to transmit the reduced rotational speed to the cam shaft 2.

As shown in FIGS. 1 and 2, the electric motor 5 is a brush DC motor. The electric motor 5 is constituted by the motor housing 12, a motor output shaft 13, and four permanent magnets 14. The motor housing 12 rotates integrally with the timing sprocket 1. The motor output shaft 13 is arranged inside the motor housing 12 to be rotatable relative to the motor housing 12. The permanent magnets 14 are fixed to an inner circumferential surface of the motor housing 12, and function as a stator.

As shown in FIG. 1, the motor housing 12 includes a housing main body 12*a* and a power-feeding plate 11. The housing main body 12*a* is formed in a tubular shape having its bottom. The power-feeding plate 11 seals a front-end opening of the housing main body 12*a*.

The housing main body 12*a* is formed of a thin-plate-shaped stainless material (S10C) by press molding, and functions as a yoke. The housing main body 12*a* includes the dividing wall 12*b* at an axially rear end portion of the housing main body 12*a*. The dividing wall 12*b* is formed in a circular-disk shape as a bottom wall. The dividing wall 12*b* separates or divides an internal space of the motor housing 12 from an internal space of the speed-reduction mechanism 8 Moreover, the dividing wall 12*b* is formed with a shaft insertion hole 12*c* having a large diameter, at a substantially center of the dividing wall 12*b*. An after-mentioned eccentric shaft portion 39 is inserted through the shaft insertion hole 12*c*. A hole edge of the shaft insertion hole 12*c* is formed integrally with an extending portion (exiting portion) 12*d* which protrudes from the dividing wall 12*b* in the axial direction of the cam shaft 2 in a cylindrical-tube shape. Moreover, an outer circumferential portion of the dividing wall 12*b* is formed integrally with the female-thread constituting portion 12*e*.

The motor output shaft 13 is formed in a stepped tubular shape (in a cylindrical shape having multileveled surface), and functions as an armature. The motor output shaft 13 includes a large-diameter portion 13*a*, a small-diameter portion 13*b*, and a stepped portion (multilevel-linking portion) 13*c*. The stepped portion 13*c* is formed at a substantially axially center portion of the motor output shaft 13, and is a boundary between the large-diameter portion 13*a* and the small-diameter portion 13*b*. The large-diameter portion 13*a* is located on the side of the cam shaft 2 whereas the small-diameter portion 13*b* is located on the side of the plug member 56. An iron-core rotor 17 is fixed to an outer circumference of the large-diameter portion 13*a*. The eccentric shaft portion 39 constituting a part of the speed-reduction mechanism 8 is formed integrally with a rear end portion of the large-diameter portion 13*a*.

On the other hand, an annular member (tubular member) 20 is fitted over and fixed to an outer circumference of the small-diameter portion 13*b* by press fitting. A commutator 21 is fitted over and fixed to an outer circumferential surface of the annular member 20 by means of press fitting in the axial direction. Hence, an outer surface of the stepped portion 13*c* performs an axial positioning of the annular member 20 and the commutator 21. An outer diameter of the annular member 20 is substantially equal to an outer diameter of the large-diameter portion 13*a*. An axial length of the annular member 20 is slightly shorter than an axial length of the small-diameter portion 13*b*.

Lubricating oil is supplied to an inside space of the motor output shaft 13 and the eccentric shaft portion 39 in order to lubricate the bearings 37 and 38. A plug member (plug) 55 is fixedly fitted into an inner circumferential surface of the small-diameter portion 13*b* by press fitting. The plug member 55 inhibits the lubricating oil from leaking to the external.

The iron-core rotor 17 is formed of magnetic material having a plurality of magnetic poles. An outer circumferential side of the iron-core rotor 17 constitutes bobbins each having a slot. (A coil wire of) A coil 18 is wound on the bobbin.

The commutator 21 is made of electrical conductive material and is formed in an annular shape. The commutator 21 is divided into segments. The number of the segments is equal to the number of poles of the iron-core rotor 17. Each of the segments of the commutator 21 is electrically connected to an end portion of the coil wire of the coil 18.

Whole of the permanent magnets 14 is formed in a circular-tube shape. Each of the permanent magnets 14 is in an arc shape in cross section as obtained by circumferentially dividing the circular-tube shape into four. An outer circumferential surface of each of the permanent magnets 14 is fixedly attached to an inner circumferential surface 12*g* of the housing main body 12*a* by adhesive 15. The permanent magnets 14 have a plurality of magnetic poles (constituted by N-pole and S-pole existing at both end portions of each magnet 14) along a circumferential direction thereof. An axial location of the permanent magnets 14 is deviated (offset) in the frontward direction from an axial location of the iron-core rotor 17. That is, with respect to the axial direction, a center of each permanent magnet 14 is located at a frontward site beyond a center of the iron-core rotor 17, as shown in FIG. 1. In other words, the power-feeding plate 11 is closer to the center of each permanent magnet 14 than to the center of the iron-core rotor 17, with respect to the axial direction. Thereby, a front end portion of the permanent magnets 14 overlaps with the commutator 21 and also an after-mentioned switching brush 25*a*, 25*b* mounted on the power-feeding plate 11 and so on, in the radial direction of the cam shaft 2.

Figure 5:
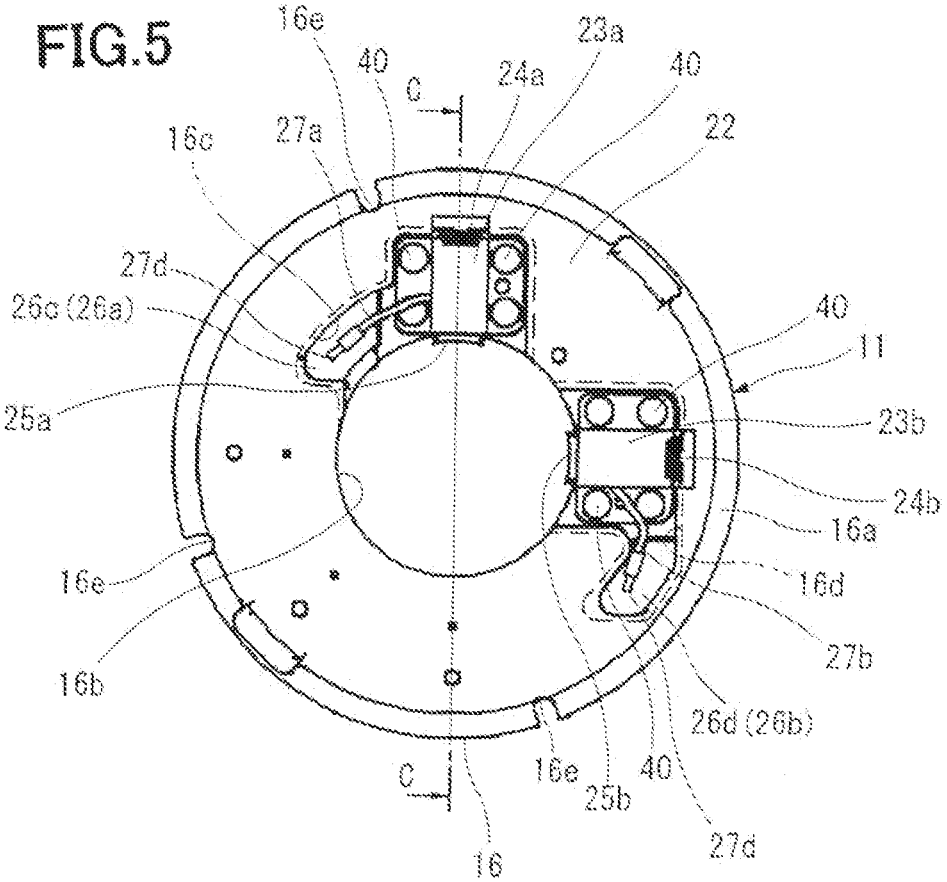
FIG. 5 is a back view of a power-feeding plate provided in the first embodiment.

As shown in FIGS. 1 and 5, the power-feeding plate 11 includes a disc-shaped rigid plate portion 16 and a circular-plate-shaped resin portion 22. The rigid plate portion 16 serves as a core, and is formed of an iron-based metallic material. Front and rear both surfaces (i.e. axially both surfaces) of the rigid plate portion 16 are coated or tightly covered with the resin portion 22.

A positioning of the rigid plate portion 16 is given by a stepped concave groove (annular groove) 12*e* formed in an inner circumference of the front end portion of the motor housing 12. An outer circumferential portion 16*a* of the rigid plate portion 16 which is not covered with the resin portion 22 and thereby exposed is fixed into the concave groove 12*e* of the motor housing 12 by caulking. A shaft insertion hole 16*b* is formed in the rigid plate portion 16 to pass through a center portion of the rigid plate portion 16 in the axial direction. One end portion of the motor output shaft 13 and so on are passing through the shaft insertion hole 16*b*. Moreover, as shown in FIG. 5, the rigid plate portion 16 is formed with two retaining holes 16*c* and 16*d* which have shapes different from each other. The two retaining holes 16*c* and 16*d* are formed by punching, and are continuous with a circumferential edge of the shaft insertion hole 16*b*, i.e., are open to the shaft insertion hole 16*b*. After-mentioned brush holders 23*a* and 23*b* are respectively placed at the retaining holes 16*c* and 16*d* and fixed to the retaining holes 16*c* and 16*d*.

As shown in FIG. 5, the outer circumferential portion 16*a* which is not covered with the resin portion 22 is formed with three U-shaped grooves 16*e* located at circumferentially predetermined spots of the outer circumferential portion 16*a*. By means of these U-shaped grooves 16*e* and jigs (not shown), a circumferential positioning of the power-feeding plate 11 is performed relative to the housing main body 12*a*.

As shown in FIGS. 1 and 5, the power-feeding plate 11 further includes the pair of brush holders 23*a* and 23*b*, the pair of switching brushes 25*a* and 25*b* each functioning as a commutator, inner and outer power-feeding slip rings 26*a* and 26*b*, and a pair of pigtail harnesses 27*a* and 27*b* (conducting wires). Each of the pair of brush holders 23*a* and 23*b* is formed of copper material. The brush holders 23*a* and 23*b* are respectively provided inside the retaining holes 16*c* and 16*d* of the rigid plate portion 16, and fixed to the resin portion 22 by a plurality of rivets 40. The pair of switching brushes 25*a* and 25*b* are received or accommodated respectively in the pair of brush holders 23*a* and 23*b* such that the switching brushes 25*a* and 25*b* are able to slide in contact with the brush holders 23*a* and 23*b* in the radial direction. Thereby, an arc-shaped tip surface of each of the switching brushes 25*a* and 25*b* is elastically in contact with an outer circumferential surface of the commutator 21 in the radial direction by a spring force of coil spring 24*a*, 24*b*. The inner and outer power-feeding slip rings 26*a* and 26*b* are buried in and fixed to a front end portion of the resin portion 22 under a state where front end surfaces of the power-feeding slip rings 26*a* and 26*b* are exposed to the space portion S. As shown in FIG. 1, the inner and outer power-feeding slip rings 26*a* and 26*b* are disposed at an identical axial location and disposed at radially inner and outer locations in a manner of radially-double layout. The pigtail harness 27*a* electrically connects the switching brush 25*a* with the slip ring 26*b* whereas the pigtail harness 27*b* electrically connects the switching brush 25*b* with the power-feeding slip ring 26*a*.

The radially-inner slip ring 26*a* has a small diameter whereas the radially-outer slip ring 26*b* has a large diameter. Each of the slip rings 26*a* and 26*b* is formed in an annular shape from a thin plate made of copper material, by punching press. As shown in FIG. 5, a part 26*c*, 26*d* of a rear end surface (cam-ring-side surface) of each of the slip rings 26*a* and 26*b* is not covered with the resin portion 22 and exposed to the internal space of the motor housing 12.

The retaining member 28 is attached to the cover main body 3*a* of the cover member 3. The retaining member 28 is integrally molded by synthetic resin material.

Figure 6:
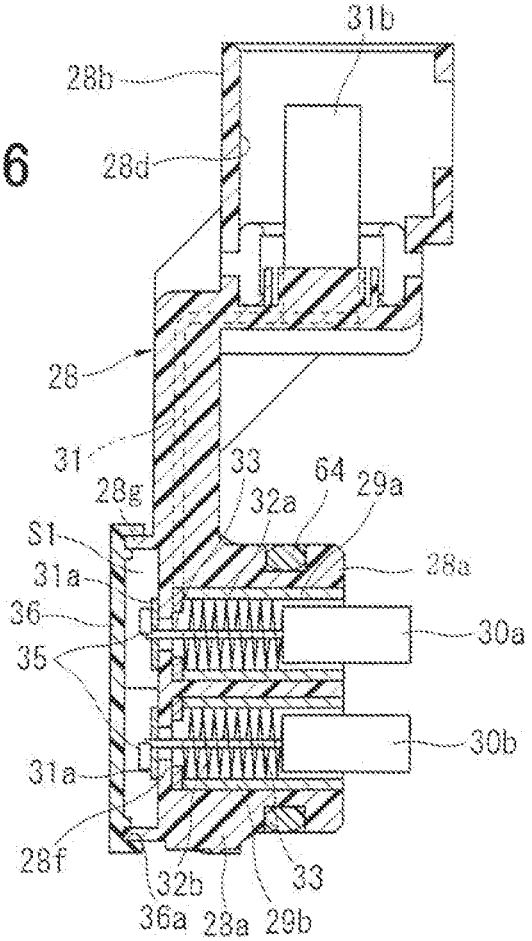
FIG. 6 is a longitudinal sectional view of a retaining member provided in the first embodiment.

As shown in FIGS. 1, 2 and 6, the retaining member 28 is substantially formed in a crank shape as viewed laterally, i.e., in cross section taken by a plane parallel to the axial direction and parallel to an extending direction of an after-mentioned power-feeding terminal strip 31. The retaining member 28 mainly includes a brush retaining portion 28*a*, a power-source connector portion 28*b*, a bracket portion 28*c*, and a pair of power-feeding terminal strips (metallic connecter plates) 31 and 31. The brush retaining portion 28*a* is substantially in a cylindrical shape having its bottom, and is inserted in the retaining hole 3*d* of the cover member 3. The power-source connector portion 28*b* is located on the side opposite to the brush retaining portion 28*a*. The bracket portion 28*c* is formed integrally with the brush retaining portion 28*a*, and protrudes from one side surface of the brush retaining portion 28*a* in a direction perpendicular to the axial direction and perpendicular to the extending direction of the power-feeding terminal strip 31. Through the bracket portion 28*c*, the retaining member 28 is fixed to the cover main body 3*a* by a bolt. A part of the pair of power-feeding terminal strips 31 and 31 is buried in the retaining member 28.

The brush retaining portion 28*a* is provided to extend in a substantially horizontal direction (i.e., in the axial direction of the cam ring 2). As shown in FIG. 6, the brush retaining portion 28*a* is formed with a pair of through-holes located at upper and lower portions of the brush retaining portion 28*a* (i.e., at radially outer and inner portions with respect to an axis of the motor housing 12 or the phase change mechanism 4). The through-holes extend in the axial direction of the cam shaft 2 and extend parallel to each other. A pair of brush guide holders 29*a* and 29*b* each having a square-tube shape are provided respectively in the through-holes of the brush retaining portion 28*a*, and are respectively fixed to the through-holes. A pair of power-feeding brushes 30*a* and 30*b* are received and retained respectively in the brush guide holders 29*a* and 29*b* to allow the power-feeding brushes 30*a* and 30*b* to slide on the brush guide holders 29*a* and 29*b* in the axial direction. A tip surface of each of the power-feeding brushes 30*a* and 30*b* is in contact with the slip ring 26*a*, 26*b* in the axial direction. Moreover, the brush retaining portion 28*a* includes a circular bottom wall 28*f* which partly closes the through-holes. The circular bottom wall 28*f* is formed integrally with an annular protruding portion 28*g* located at an outer circumferential edge of the circular bottom wall 28*f*. The annular protruding portion 28*g* protrudes in the axial direction of the cam shaft 2, and an after-mentioned cap 36 is fitted over the annular protruding portion 28*g* such that the cap 36 is fixed or fastened to the annular protruding portion 28*g*.

A circular space S1 separated or surrounded by the annular protruding portion 28*g* is formed outside the bottom wall 28*f*, i.e., is located outside the bottom wall 28*f* with respect to the axial direction of the cam shaft 2. A depth of the space S1 (i.e., a length of the space S1 with respect to the axial direction of the cam shaft 2) is set at a size enabling space S1 to absorb (accommodate) a bending or deflecting deformation of an after-mentioned pigtail harness 33 when the power-feeding brush 30*a*, 30*b* has backwardly moved (has fallen back) inside the brush guide holder 29*a*, 29*b*. An axial opening of the space S1 which is shaped by the retaining member 28 is covered by the circular cap 36 made of a synthetic resin material. Accordingly, the space S1 is liquid-tightly closed by the circular cap 36. The protruding portion 28*g* is fitted into an annular groove 36*a* which is formed in an outer circumferential portion of the cap 36 and which is in a U-shape in cross section, so that the cap 36 is hooked and fixed to the brush retaining portion 28*a*.

Each of the power-feeding brushes 30*a* and 30*b* is formed in a substantially rectangular-column shape. Each of a pair of coil springs 32*a* and 32*b* is elastically disposed between a backend portion (a bottom-side end portion) of the power-feeding brush 30*a*, 30*b* and the bottom wall 28*f*. The power-feeding brushes 30*a* and 30*b* are biased respectively toward the slip rings 26*a* and 26*b* by spring forces of the coil springs 32*a* and 32*b*, so that the tip surface of each of the power-feeding brushes 30*a* and 30*b* is elastically in contact with the slip ring 26*a*, 26*b*.

Moreover, one of the pair of pigtail harnesses (conducting wires) 33 and 33 which can change in shape because of a flexibility thereof is connected with the backend portion of the power-feeding brush 30*a* and one of after-mentioned one-side terminals 31*a* and 31*a* of the power-feeding terminal strips 31 and 31 to establish an electrical connection between the backend portion of the power-feeding brush 30*a* and the one of the one-side terminals 31*a* and 31*a*. In the same manner, another of the pair of pigtail harnesses 33 and 33 is connected with the backend portion of the power-feeding brush 30*b* and another of the one-side terminals 31*a* and 31*a* to establish an electrical connection between the backend portion of the power-feeding brush 30*b* and the another of the one-side terminals 31*a* and 31*a*. As shown in FIG. 6, a length of each of the pigtail harnesses 33 and 33 is designed to restrict a maximum sliding position of the power-feeding brush 30*a*, 30*b* such that the power-feeding brush 30*a*, 30*b* is prevented from dropping out from the brush guide holder 29*a*, 29*b* when the power-feeding brush 30*a*, 30*b* has moved (risen) and slid in an axially-outward direction at the maximum by the coil spring 32*a*, 32*b*.

As shown in FIG. 6, an annular (ring-shaped) seal member 64 is fitted into and held by an annular fitting groove which is formed in an outer circumference of a base portion side of the brush retaining portion 28*a*. The annular seal member 64 seals between the brush retaining portion 28*a* and the cover main body 3*a*.

The male connector (not shown) is inserted into a female fitting groove 28*d* which is located at an upper end portion of the connector portion 28*b*. After-mentioned another-side terminals (upper-side terminals) 31*b* and 31*b* of the power-feeding terminal strips 31 and 31 which are exposed to the female fitting groove 28*d* of the connector portion 28*b* are electrically connected through the male connector to a control unit (not shown) which functions as a controller.

Figure 7:
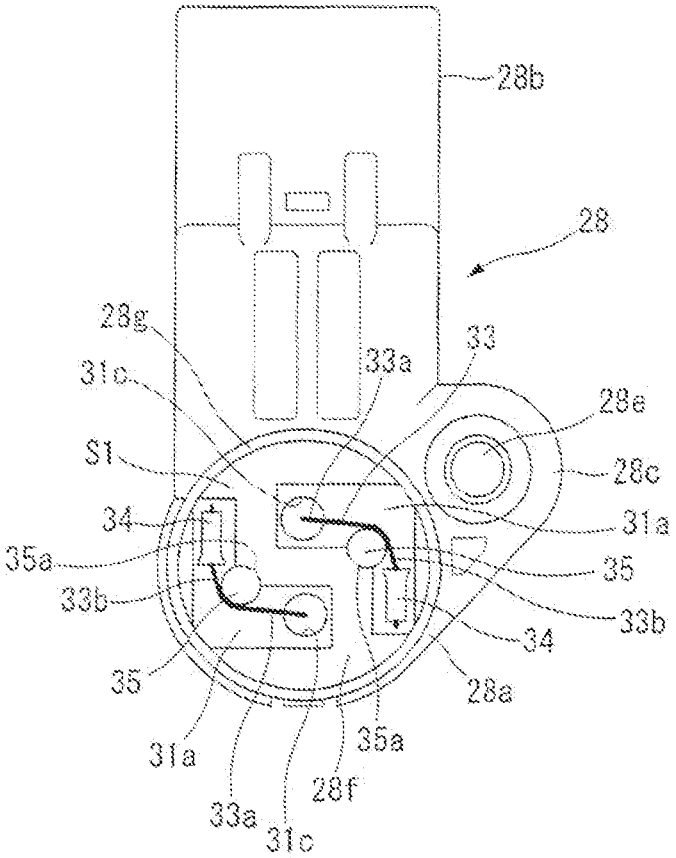
FIG. 7 is a front view of the retaining member provided in the first embodiment, under a state where a cap was detached from the retaining member.

As shown in FIGS. 2 and 7, the bracket portion 28*c* is formed in an oblique inverse-U shape and formed with a bolt insertion hole 28*e*. The bolt insertion hole 28*e* located at one side of the brush retaining portion 28*a* axially passes through the bracket portion 28*c*. A bolt (not shown) is inserted through the bolt insertion hole 28*e*, and is screwed into a female threaded hole (not shown) formed in the cover main body 3*a*. Thereby, whole of the retaining member 28 is fixed to the cover main body 3*a* through the bracket portion 28*c*.

As shown in FIG. 1, the power-feeding terminal strips 31 and 31 extend in the upper-lower direction, and extend parallel to each other. The pair of power-feeding terminal strips 31 and 31 are formed in a crank shape. The one-side terminal (lower portion) 31*a* for each of the power-feeding terminal strips 31 and 31 is positioned on and fastened to the outside surface of the circular bottom wall 28*f* of the brush retaining portion 28*a* to be exposed to the space S1 whereas the another-side terminal (upper portion) 31*b* for each of the power-feeding terminal strips 31 and 31 is introduced in the female fitting groove 28*d* of the connector portion 28*b* and protrudes from a bottom of the female fitting groove 28*d*, as shown in FIGS. 1 and 6.

Figure 8:
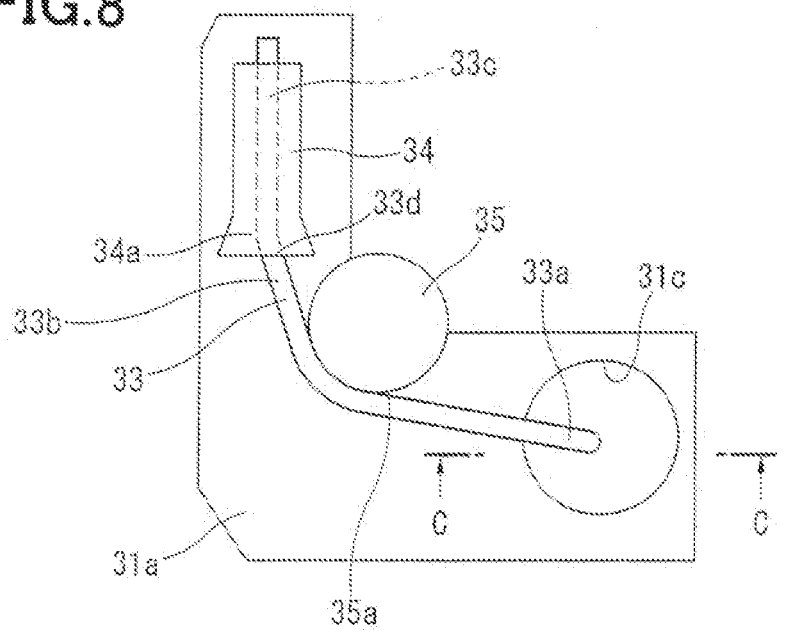
FIG. 8 is an enlarged view of a main part of FIG. 7.

As shown in FIGS. 7 and 8, each of the one-side terminals 31*a* and 31*a* is formed to be bent in a substantially L-shape, as viewed in the axial direction of the cam shaft 2. In consideration of layout, the one-side terminals 31*a* and 31*a* are arranged on the axially-outside surface of the bottom wall 28*f* of the brush retaining portion 28*a* such that inner sides (inner right-angle sides) of the L-shapes of the one-side terminals 31*a* and 31*a* face to each other. On the other hand, the another-side terminals 31*b* and 31*b* of the power-feeding terminal strips 31 and 31 are electrically connected through the male connector to a battery power source.

Specific connecting and routing structures of the pigtail harnesses 33 and 33 against the one-side terminals 31*a* and 31*a* will be explained later.

As shown in FIG. 1, the motor output shaft 13 and the eccentric shaft portion 39 are rotatably supported by the small-diameter ball bearing 37 and the needle bearing 38. The small-diameter ball bearing 37 is provided on an outer circumferential surface of the shaft portion 10*b* of the cam bolt 10. The needle bearing 38 is provided on an outer circumferential surface of the cylindrical portion 9*b* of the follower member 9, and is located axially adjacent to the small-diameter ball bearing 37.

The needle bearing 38 includes a cylindrical retainer 38*a* and a plurality of needle rollers 38*b*. The retainer 38*a* is formed in a cylindrical shape (circular-tube shape), and is fitted in an inner circumferential surface of the eccentric shaft portion 39 by press fitting. Each needle roller 38*b* is a rolling element supported rotatably inside the retainer 38*a*. The needle rollers 38*b* roll on the outer circumferential surface of the cylindrical portion 9*b* of the follower member 9.

The inner race of the small-diameter ball bearing 37 is fixed between a front end edge of the cylindrical portion 9*b* of the follower member 9 and the head portion 10*a* of the cam bolt 10 in a sandwiched state. On the other hand, an outer race of the small-diameter ball bearing 37 is fixedly fitted in a stepped diameter-enlarged portion of the inner circumferential surface of the eccentric shaft portion 39 by press fitting. The outer race of the small-diameter ball bearing 37 is axially positioned by contacting a step edge (barrier) formed in the stepped diameter-enlarged portion of the inner circumferential surface of the eccentric shaft portion 39.

A small-diameter oil seal 46 is provided between the outer circumferential surface of the motor output shaft 13 (eccentric shaft portion 39) and an inner circumferential surface of the extending portion 12*d* of the motor housing 12. The oil seal 46 prevents lubricating oil from leaking from an inside of the speed-reduction mechanism 8 into the electric motor 5. The oil seal 46 separates the electric motor 5 from the speed-reduction mechanism 8 by a searing function of the oil seal 46.

The control unit detects a current operating state of the engine on the basis of information signals derived from various kinds of sensors and the like, such as a crank angle sensor, an air flow meter, a water temperature sensor and an accelerator opening sensor (not shown). Thereby, the control unit controls the engine. Moreover, the control unit performs a rotational control for the motor output shaft 13 by supplying electric power to the coils 18 via the power-feeding brushes 30*a* and 30*b*, the slip rings 26*a* and 26*b*, the switching brushes 25*a* and 25*b*, the commutator 21 and the like. Thereby, the control unit controls a relative rotational phase of the cam shaft 2 to the timing sprocket 1, by the speed-reduction mechanism 8.

Figure 3:
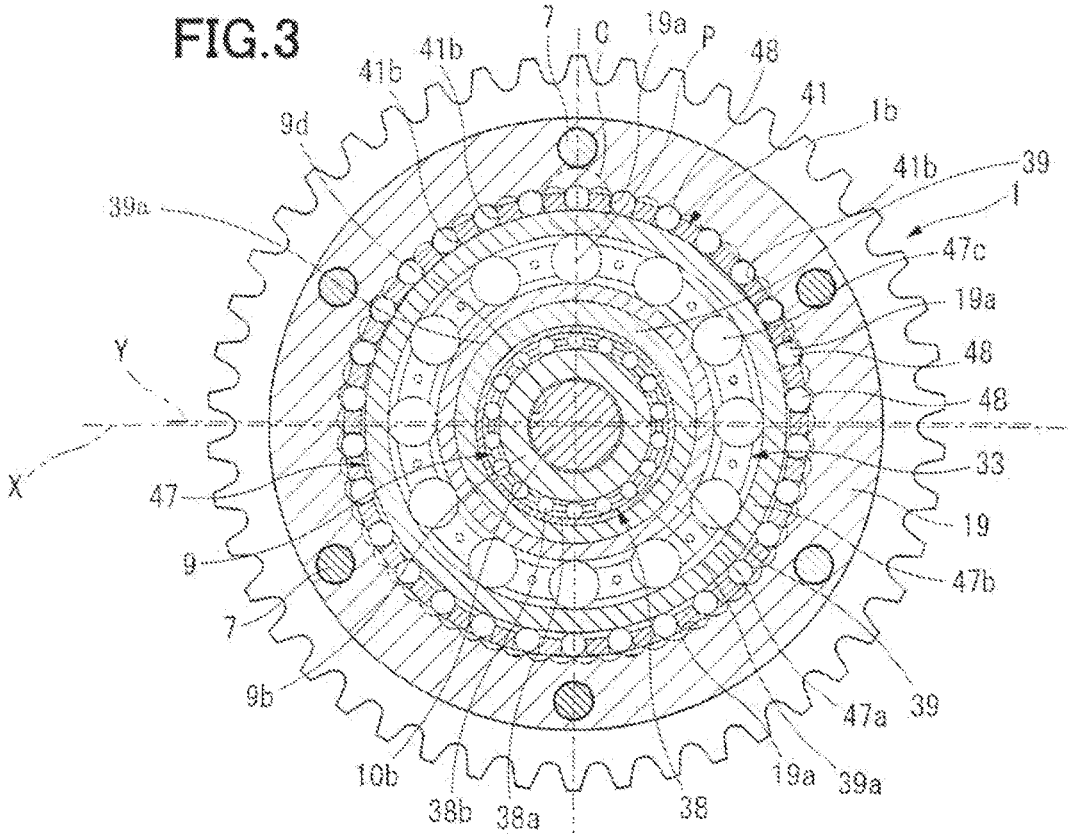
FIG. 3 is a sectional view of FIG. 1, taken along a line A-A.

As shown in FIGS. 1 to 3, the speed-reduction mechanism 8 is mainly constituted by the eccentric shaft portion 39, a medium-diameter ball bearing 47, the rollers 48, the retainer 41, and the follower member 9 formed integrally with the retainer 41. The eccentric shaft portion 39 conducts an eccentric rotational motion. The medium-diameter ball bearing 47 is provided on an outer circumference of the eccentric shaft portion 39. The rollers 48 are provided on an outer circumference of the medium-diameter ball bearing 47. The retainer 41 retains (guides) the rollers 48 along a rolling direction of the rollers 48, and permits a radial movement of each roller 48. It is noted that the eccentric shaft portion 39 and the medium-diameter ball bearing 47 constitute an eccentrically rotating section.

An outer circumferential surface of the eccentric shaft portion 39 includes a cam surface 39*a*. The cam surface 39*a* of the eccentric shaft portion 39 has a center (axis) Y which is eccentric (deviated) slightly from a shaft center X of the motor output shaft 13 in the radial direction.

Substantially whole of the medium-diameter ball bearing 47 overlaps with the needle bearing 38 in the radial direction, i.e., the medium-diameter ball bearing 47 is located approximately within an axial existence range of the needle bearing 38. The medium-diameter ball bearing 47 includes an inner race 47*a*, an outer race 47*b*, and a ball(s) 47*c* interposed between both the races 47*a* and 47*b*. The inner race 47*a* is fixed to the outer circumferential surface of the eccentric shaft portion 39 by press fitting. The outer race 47*b* is not fixed in the axial direction, and thereby is in an axially freely-movable state. That is, one of axial end surfaces of the outer race 47*b* which is closer to the electric motor 5 is not in contact with any member whereas another of the axial end surfaces of the outer race 47*b* faces an inside surface of the retainer 41 to have a first clearance (minute clearance) C between the another of the axial end surfaces of the outer race 47*b* and the inside surface of the retainer 41.

Moreover, an outer circumferential surface of the outer race 47*b* is in contact with an outer circumferential surface of each of the rollers 48 so as to allow the rolling motion of each roller 48. An annular second clearance C1 is formed on the outer circumferential surface of the outer race 47*b*. By virtue of the second clearance C1, whole of the medium-diameter ball bearing 47 can move in the radial direction in response to an eccentric rotation (of the outer circumferential surface of the large-diameter portion 39*b*) of the eccentric shaft portion 39, i.e., can perform an eccentric movement.

Each of the rollers 48 is made of iron-based metal, and formed as a cylinder solid (cylindrical column). Outer diameters of the rollers 48*a* are equal to one another. With the eccentric movement of the medium-diameter ball bearing 47, the respective rollers 48 move in the radial direction and are fitted in the internal teeth 19*a* of the internal-teeth constituting portion 19. Also, with the eccentric movement of the medium-diameter ball bearing 47, the rollers 48 are forced to do a swinging motion in the radial direction while being guided in the circumferential direction by both side edges of the roller-retaining holes 41*b* of the retainer 41. That is, the rollers 48 are moved closer to the internal teeth 19*a* and are moved away from the internal teeth 19*a*, repeatedly, by the eccentric movement of the medium-diameter ball bearing 47.

Lubricating oil is supplied into the speed-reduction mechanism 8 by a lubricating-oil supplying means (supplying section). This lubricating-oil supplying means includes an oil supply passage 51, an oil supply hole 52, a second groove (lubricating-oil groove) 53, a communication hole 54, and oil discharge holes (not shown). The oil supply passage 51 is formed inside the bearing 02 of the cylinder head 01. Lubricating oil is supplied from a main oil gallery (not shown) to the oil supply passage 51. The oil supply hole 52 is formed inside the cam shaft 2 to extend in the axial direction. The oil supply hole 52 communicates through a groove(s) 52*a* with the oil supply passage 51. The second groove 53 is formed in the rear end surface 9*c* of the follower member 9, and is open to a tip opening of the oil supply hole 52. The communication hole 54 is formed inside the follower member 9 to pass through the follower member 9 in the axial direction. One end portion of the communication hole 54 is open to the second groove 53, and another end portion of the communication hole 54 is open to a region near the needle bearing 38 and the medium-diameter ball bearing 47. The oil discharge holes are formed inside the follower member 9 to pass through the follower member 9 in the same manner.

Accordingly, through the lubricating-oil supplying means, lubricating oil pumped by an oil pump is forcibly supplied to the accommodating space 44 and held in the accommodating space 44. Thereby, the lubricating oil lubricates the medium-diameter ball bearing 47 and the rollers 48. Moreover, the lubricating oil flows to the inside of the eccentric shaft portion 39 and the inside of the motor output shaft 13 so that moving elements such as the needle bearing 38 and the small-diameter ball bearing 37 are lubricated. It is noted that the small-diameter oil seal 46 inhibits the lubricating oil held in the accommodating space 44 from leaking to the inside of the motor housing 12.

Each of the one-side terminals 31*a* and 31*a* is formed with a harness insertion hole 31*c* which is located in one end portion of the one-side terminal 31*a* and which passes through the one-side terminal 31*a*. That is, as shown in FIGS. 7 and 8, each harness insertion hole 31*c* is formed in an end portion of a horizontally extending portion of the L-shaped one-side terminal 31*a* which extends in the horizontal direction (i.e., in a direction perpendicular to the extending direction of the power-feeding terminal strip 31). One end portions 33*a* and 33*a* of the pigtail harnesses 33 and 33 are respectively inserted into the insertion holes 31*c* and 31*c* of the one-side terminals 31*a* and 31*a*. On an upper surface (i.e., a space-S1-side surface) of another end portion of each of the one-side terminals 31*a* and 31*a*, a crimp contact (crimping component) 34 is fixedly combined with a tip portion (i.e. fixing portion) 33*c* of another end portion 33*b* of the pigtail harness 33. That is, as shown in FIGS. 7 and 8, the fixing portion 33*c* of each pigtail harness 33 is fixed through the crimp contact 34 to an end portion of a vertically extending portion of the L-shaped one-side terminal 31*a* which extends in the vertical direction (i.e., in the extending direction of the power-feeding terminal strip 31). A guide portion 35 is provided at an inner bending portion of a center of each of the L-shaped one-side terminals 31*a* and 31*a*. The guide portion 35 guides the pigtail harness 33 in bending along the L-shape of the one-side terminal 31*a*.

Figure 9:
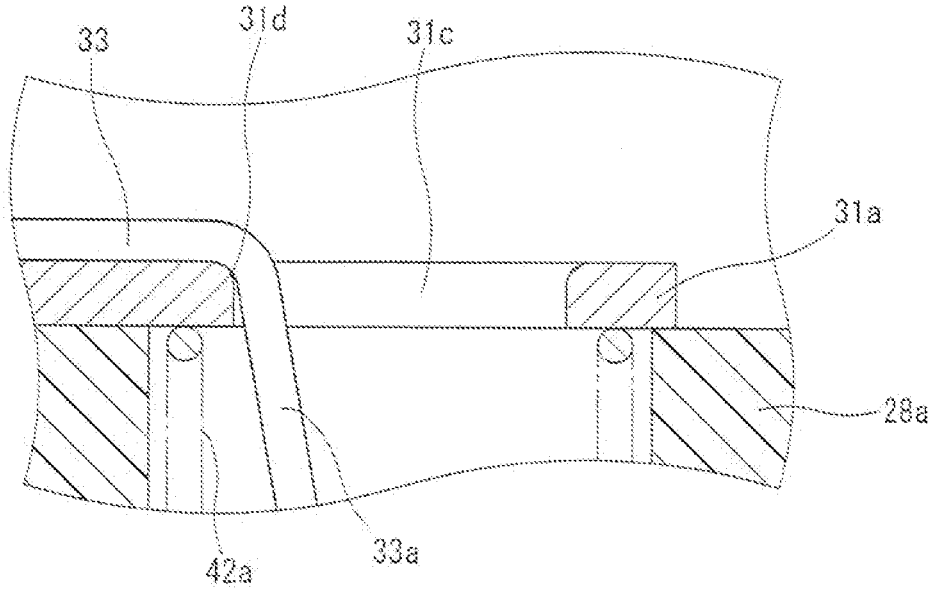
FIG. 9 is a sectional view of FIG. 8, taken along a line C-C.

As shown in FIG. 9, each of the insertion holes 31*c* and 31*c* includes a rounded surface 31*d* which is located at an outside hole edge of the insertion hole 31*c* and which is formed in a chamfer shape. The rounded surface 31*d* of the outside hole edge of the insertion hole 31*c* has a curvature radius falling within a range from 0.1 mm to 0.5 mm. Hence, as shown in FIG. 9, each pigtail harness 33 is in contact with the rounded surface 31*d* of the insertion hole 31*c* under the condition that the pigtail harness 33 bends toward the through-hole of the brush retaining portion 28*a* at a somewhat obtuse angle but not at a right angle. Accordingly, a contact pressure of this pigtail harness 33 against the rounded surface 31*d* is reduced (dispersed) so that a bending load of the pigtail harness 33 is reduced.

Figure 10A:
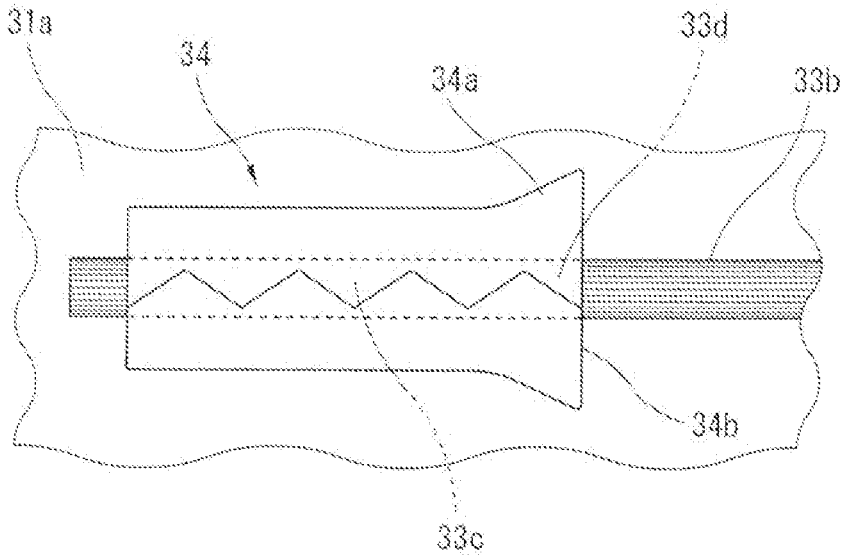
FIG. 10A is a side view of a crimp contact provided in the first embodiment, under a state where another end portion of a pigtail harness is crimped and fixed to the crimp contact.
Figure 10B:
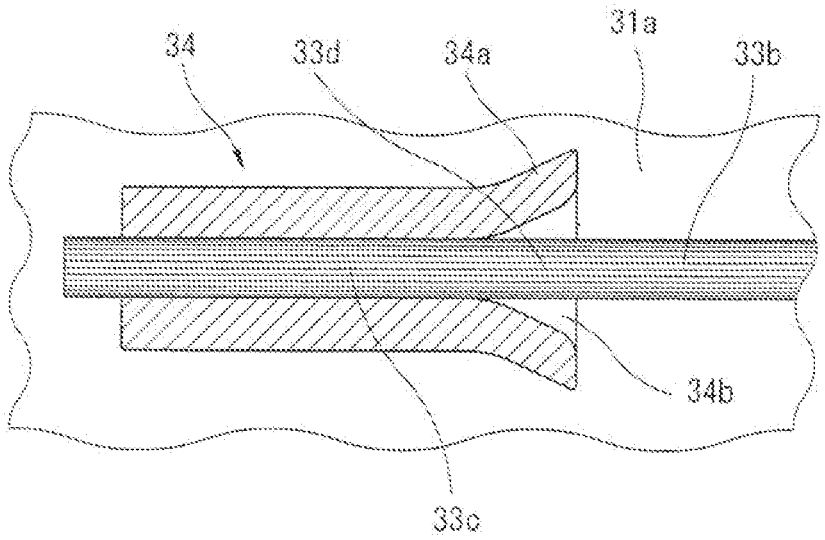
FIG. 10B is a longitudinal sectional view of FIG. 10A.

As shown in FIGS. 10A and 10B, the crimp contact is formed in a circular-tube shape by bending a copper-plate material in a pipe shape. The fixing portion 33*c* constituted by bound thin wires of the another end portion 33*b* of the pigtail harness 33 is inserted from an opening portion 34*b* of an axially front end portion 34*a* of the crimp contact 34 into the circular-tube shape of the crimp contact 34 inwardly in an axial direction of the crimp contact 34. Then, the inserted fixing portion 33*c* is crimped and fixed onto the one-side terminal 31*a*. It is noted that the fixing portion 33*c* is defined by an existing range of the crimp contact 34, i.e. a length of the fixing portion 33*c* is equal to an axial length of the crimp contact 34.

As shown in FIG. 10B, the front end portion 34*a* (the opening 34*b*) of the crimp contact 34 is formed such that a diameter of the front end portion 34*a* is gradually enlarged toward an edge of the front end portion 34*a* in a horn shape. A part (end part) 33*d* of the fixing portion 33*c* of the another end portion 33*b* of the pigtail harness 33 is not crimped or fixed, and thereby can move freely. This end part 33*d* is located in a region of the front end portion 34*a* (the opening 34*b*).

A part of an outer circumferential surface of the crimp contact 34 (including the front end portion 34*a*) is formed in a flat shape, and extends in the axial direction of the crimp contact 34. This flat-shape surface of the crimp contact 34 is fixed to the upper surface of the one-side terminal 31*a* by ultrasonic bonding.

Figure 11:
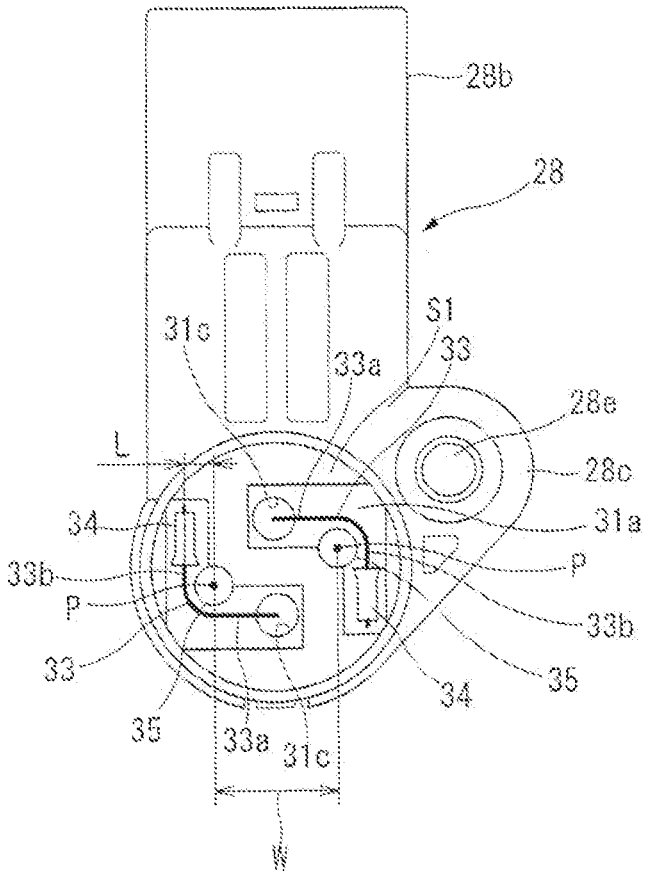
FIG. 11 is a front view of the retaining member in the first embodiment, under a state where the cap was detached from the retaining member attached to a cover member.

As shown in FIGS. 1, 7 and 11, each guide portion 35 is formed integrally with the bottom wall 28*f* of the brush retaining portion 28*a* such that the guide portion 35 protrudes from the outside surface of the bottom wall 28*f*. That is, the guide portion 35 is in a substantially cylindrical-column shape, and is made of a synthetic-resin material identical with the brush retaining portion 28*a*. The guide portion 35 is located at an inner side of a central corner portion (i.e. the bending portion) of the L-shape of the one-side terminal 31*a*, as viewed in the axial direction of the brush guide holder 29*a*, 29*b*. That is, as shown in FIGS. 7 and 11, the guide portion 35 is located inwardly near a 90-degree-angle intersection point formed by an imaginary line passing through (a center of) the harness insertion hole 31*c* and an imaginary line passing through (a center of) the crimp contact 34 on the one-side terminal 31*a*.

Figure 12:
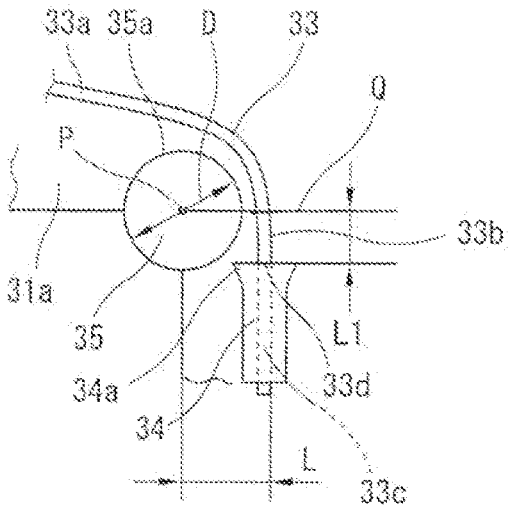
FIG. 12 is an enlarged front view of a part of the retaining member shown in FIG. 11.

As shown in FIG. 12, each guide portion 35 has a uniform outer diameter D substantially equal to 3.5 mm. As shown in FIG. 11, a length W between axes (center lines) P and P of the both guide portions 35 and 35 in the horizontal direction is substantially equal to 11.6 mm. As shown in FIG. 11, a length (distance) L between the axis P of the guide portion 35 and an axis (center line) of the corresponding crimp contact 34 is equal to 2.8 mm.

As shown in FIG. 12, a length (distance) L1 between the front edge of the front end portion 34*a* of the crimp contact 34 and an imaginary radial line Q of the guide portion 35 is larger than or equal to about 0.8 mm. This imaginary radial line Q extends perpendicularly to the axis of the crimp contact 34 (i.e., substantially perpendicularly to the another end portion 33*b* of the pigtail harness 33) from the axis P of the guide portion 35. The reason why the length L1 is set to be larger than or equal to 0.8 mm is based on experimental results obtained by the inventors of the present application, and specific explanations thereof will be given below.

An axial length of the guide portion 35 is slightly smaller than the depth (height) of the space S1. That is, the axial length of the guide portion 35 is designed not to interfere with the cap 36.

As shown in FIG. 6, before the retaining member 28 is attached to the cover member 3 (i.e. at the time of factory shipment of components), each of the power-feeding brushes 30*a* and 30*b* is biased ahead (has moved out to a maximum extent) by spring force of the coil spring 32*a*, 32*b* so that a tip portion of the power-feeding brush 30*a*, 30*b* protrudes greatly ahead from the brush guide holder 29*a*, 29*b*. Under this state, each pigtail harness 33 is pulled by the spring force of the coil spring 32*a*, 32*b*. Hence, as shown in FIGS. 7 and 8, the pigtail harness 33 is elastically in contact with an outer circumferential surface 35*a* of the guide portion 35 so that the pigtail harness 33 is bent in a substantially dogleg shape (at obtuse angle).

On the other hand, when the retaining member 28 is attached to the cover member 3 (i.e. when mounting components on the engine), the power-feeding brush 30*a*, 30*b* moves backwardly against the spring force of the coil spring 32*a*, 32*b* because a tip surface of the power-feeding brush 30*a*, 30*b* is elastically in contact with the slip ring 26*a*, 26*b* as shown in FIG. 1. Hence, the pigtail harness 33 is no longer pulled by the coil spring 32*a*, 32*b*. At this time, each pigtail harness 33 is slightly deformed in a deflecting manner in a depth direction of the space S1. Moreover, as shown in FIGS. 11 and 12, the pigtail harness 33 bends at a substantially right angle (90-degree angle) such that a bending portion of the pigtail harness 33 has a space from (i.e. is not in contact with) the outer circumferential surface 35*a* of the guide portion 35 as viewed in the axial direction of the brush guide holder 29*a*, 29*b*.

Operations in First Embodiment

Operations in this embodiment according to the present invention will now be explained. At first, when the crankshaft of the engine is drivingly rotated, the timing sprocket 1 is rotated through the timing chain. This rotative force is transmitted through the internal-teeth constituting portion 19 and the female-thread constituting portion 12*e* to the motor housing 12. Thereby, the motor housing 12 rotates in synchronization. On the other hand, the rotative force of the internal-teeth constituting portion 19 is transmitted through the rollers 48, the retainer 41 and the follower member 9 to the cam shaft 2. Thereby, the cam of the cam shaft 2 opens and closes the intake valve.

Under a predetermined engine-operating state after the start of the engine, the control unit supplies electric power to the coils 18 of the electric motor 5 through the terminal strips 31 and 31, the pigtail harnesses, the power-feeding brushes 30*a* and 30*b* and the slip rings 26*a* and 26*b* and the like. Thereby, the rotation of the motor output shaft 13 is driven. This rotative force of the motor output shaft 13 is transmitted through the speed-reduction mechanism 8 to the cam shaft 2 so that a reduced rotation is transmitted to the cam shaft 2.

That is, (the outer circumferential surface of) the eccentric shaft portion 39 eccentrically rotates in accordance with the rotation of the motor output shaft 13. Thereby, each roller 48 rides over (is disengaged from) one internal tooth 19*a* of the internal-teeth constituting portion 19 and moves to the other adjacent internal tooth 19*a* with its rolling motion while being radially guided by the roller-retaining holes 41*b* of the retainer 41, every one rotation of the motor output shaft 13. By repeating this motion sequentially, each roller 48 rolls in the circumferential direction under a contact state. By this contact rolling motion of each roller 48, the rotative force is transmitted to the follower member 9 while the rotational speed of the motor output shaft 13 is reduced. A speed reduction rate which is obtained at this time can be set at any value, by adjusting a difference between the number of rollers 48 and the number of internal teeth 19*a*.

Accordingly, the cam shaft 2 rotates in the forward or reverse direction relative to the timing sprocket 1 so that the relative rotational phase between the cam shaft 2 and the timing sprocket 1 is changed. Thereby, opening and closing timings of the intake valve are controllably changed to its advance or retard side.

As shown in FIG. 4, a maximum positional restriction (angular position limitation) for the forward/reverse relative rotation of cam shaft 2 to the timing sprocket 1 is performed when one of respective lateral surfaces (circumferentially-opposed surfaces) of the stopper convex portion 61*d* becomes in contact with the corresponding one of the circumferentially-opposed surfaces 2*c* and 2*d* of the stopper concave groove 2*b*.

Therefore, the opening and closing timings of the intake valve can be changed to the advance side or the retard side up to its maximum. Therefore, a fuel economy and an output performance of the engine are improved.

In this embodiment, the fixing portion 33*c* of the another end portion 33*b* of the pigtail harness 33 inside the retaining member 23 is connected with the one-side terminal 31*a* by use of the crimp contact 34, but not by mere soldering. Hence, a concentrated stress (stress concentration) is not applied to a connecting spot between the another end portion 33*b* and the crimp contact 34 even if vibrations caused due to alternating torque of the cam shaft 2 and the like are transmitted to the another end portion 33*b*.

Particularly in this embodiment, before the retaining member 28 shown in FIG. 7 is attached to the cover member 3 (i.e. at the time of factory shipment of components), each pigtail harness 33 is elastically in contact with the outer circumferential surface 35*a* of the guide portion 35 by spring force of the coil spring 32*a*, 32*b* as mentioned above. As a result, as shown in FIGS. 7 and 8, the pigtail harness 33 is bent in the substantially dogleg shape (obtuse-angle shape) as viewed in the axial direction of the cam shaft 2 such that this dogleg shape is memorized i.e., such that the pigtail harness 33 becomes in the habit of forming such a bending shape.

Afterwards, when the retaining member 28 has been attached to the cover member 3, each pigtail harness 33 bends at the substantially right angle and departs from the guide portion 35 as shown in FIG. 11. Thereby, the another end portion 33*b* of the pigtail harness 33 linearly extends toward the crimp contact 34 substantially in parallel with the axis (center line) of the crimp contact 34, and is connected with the crimp contact 34 substantially coaxially to the crimp contact 34. Accordingly, the concentrated stress can be inhibited from occurring at the end part 33*d* (of the fixing portion 33*c*) which is a root portion of the another end portion 33*b* and which is located at the edge of the front end portion 34*a* of the crimp contact 34.

That is, in a case that the pigtail harness 33 is connected with the crimp contact 34 under the condition that the another end portion 33*b* of the pigtail harness 33 (i.e. an extending direction of the another end portion 33*b* near the fixing portion 33*c*) is largely inclined relative to the axis of the crimp contact 34, it is easy to cause the concentrated stress at the end part 33*d* of the fixing portion 33*c* which is folded (sharply bent). However, in the case of the first embodiment according to the present invention, the end part 33*d* of the fixing portion 33*c* is straightly continuous with a main part of the fixing portion 33*c* fixed to the crimp contact 34, i.e. extends substantially in parallel with whole the fixing portion 33*c* and also the axis of the crimp contact 34. Accordingly, in this embodiment, the occurrence of concentrated stress is suppressed. It is noted that the above-mentioned wording "straightly" or "parallel" may have a slight inclination.

Each crimp contact 34 is formed in the cylindrical-tube shape, and the another end portion 33*b* of the pigtail harness 33 exits from (i.e., extends out from) the crimp contact 34 substantially linearly in the axial direction of the cylindrical-tube shape of the crimp contact 34. Hence, the concentrated stress which is applied to the end part 33*d* in the another end portion 33*b* is further reduced.

As mentioned above, the distance L1 between the front edge of the front end portion 34*a* of the crimp contact 34 and the imaginary radial line Q of the guide portion 35 shown in FIG. 12 is larger than or equal to 0.8 mm. Accordingly, the concentrated stress at the end part 33*d* can be further reduced. In other words, the another end portion 33*b* of each pigtail harness 33 straightly extends parallel to the axis of the crimp contact 34 over the distance L1. Because this distance L1 for straightly-linear extension of the another end portion 33*b* is long (i.e. larger than or equal to 0.8 mm), the concentrated stress is reduced in the first embodiment.

The inventors of the present application have obtained, by experiments, a relation between the length (distance) L1 and the concentrated stress (maximum principal stress) acting on the end part 33*d* of the another end portion 33*b*. This relation is shown in a graph of FIG. 13.

Figure 13:
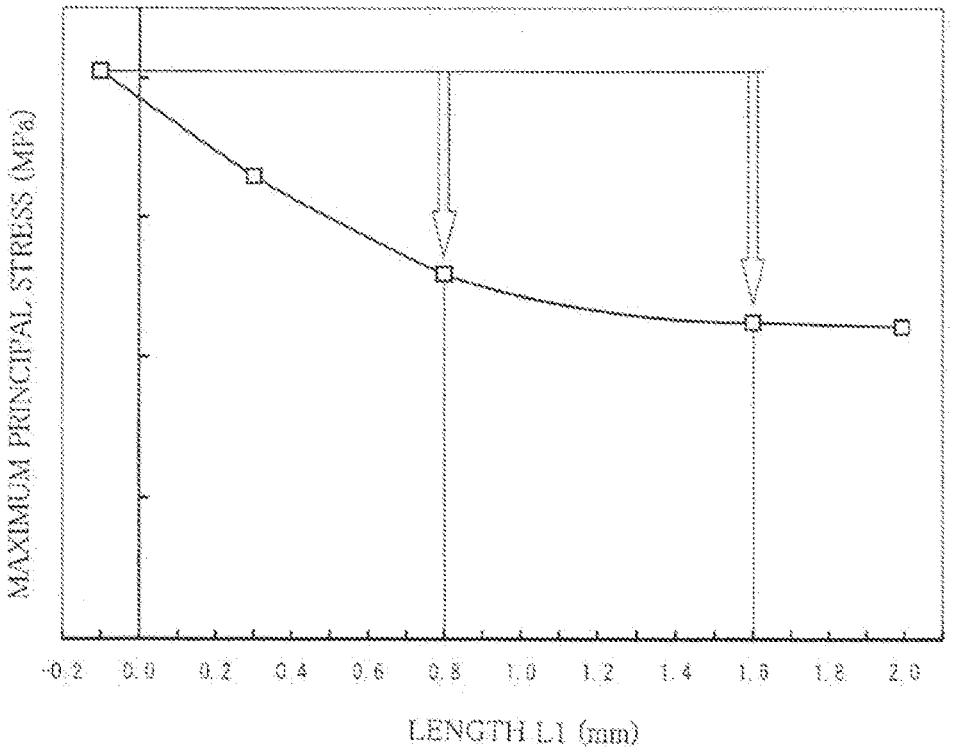
FIG. 13 is a graph showing a relation between a maximum principal stress and a length L1.

In the experiments shown in FIG. 13, the length L1 is gradually elongated from −0.1 mm. As recognized from FIG. 13, the maximum principal stress takes its largest value (unit: MPa) when the length L1 is equal to −0.1 mm. The maximum principal stress is sharply reduced when the length L1 is changed in a range from −0.1 mm to 0.8 mm. Then, the maximum principal stress is gently reduced when the length L1 is changed in a range from 0.8 mm to 2.0 mm.

Therefore, in the case that the length L1 is set to be larger than or equal to 0.8 mm, the concentrated stress which acts on the end part 33*d* of the another end portion 33*b* can be reduced by about 30 percent (30%) or more as compared with the case that the length L1 is equal to −0.1 mm.

This is because a linearity (parallelism) of the another end portion 33*b* relative to the fixing portion 33*c* or the axis of the crimp contact 34 is sufficiently ensured.

Because the length L1 is set to be larger than or equal to 0.8 mm in the first embodiment, a breaking (disconnection) of the pigtail harness 33 or the like is inhibited from occurring at the end part 33*d* of the fixing portion 33*c* in which the another end portion 33*b* of the pigtail harness 33 and the crimp contact 34 are fixed to each other. As a result, a durability of the pigtail harness 33 is enhanced.

The front end portion 34*a* of the crimp contact 34 is formed to have the horn-shaped opening 34*b* whose diameter is gradually enlarged toward the edge of the front end portion 34*a*. Accordingly, the end part 33*d* of the another end portion 33*b* of the pigtail harness 33 which is located at the opening 34*b* is able to move freely (radially). Hence, the bending or deflecting deformation of the another end portion 33*b* of the pigtail harness 33 can be absorbed in (i.e., does not interfere with) the opening 34*b*. Also for this reason, the stress concentration at the end part 33*d* of the another end portion 33*b* is suppressed, so that the durability of the pigtail harness 33 is further enhanced.

Moreover, because the outside hole edge of the harness insertion hole 31*c* is formed to be the rounded surface 31*d*, the one end portion 33*a* of each pigtail harness 33 is inhibited from causing a bending stress at the outside hole edge of the harness insertion hole 31*c*.

Second Embodiment

Figure 14:
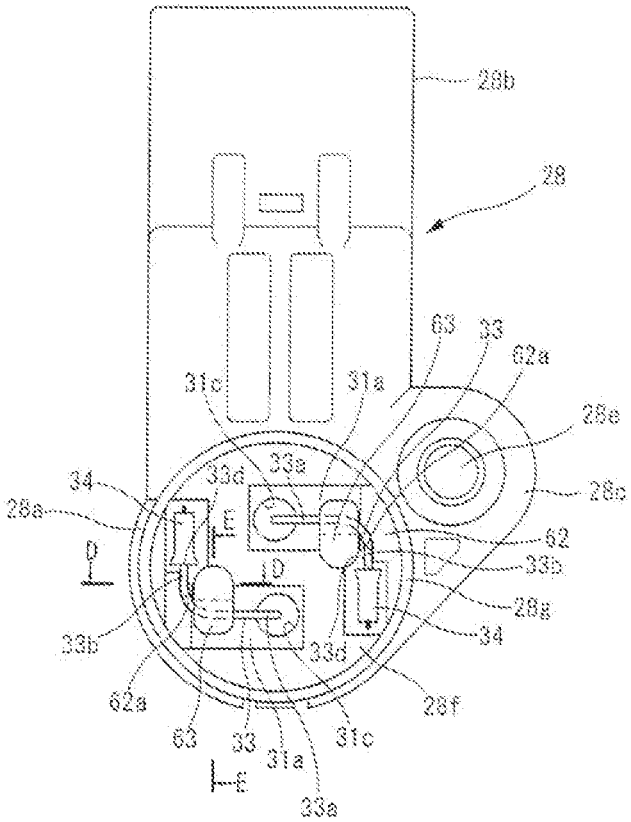
FIG. 14 is a front view of a retaining member provided in a second embodiment according to the present invention, under a state where a cap was detached from the retaining member.

FIG. 14 shows a second embodiment according to the present invention. In the second embodiment, a retainer wall 62 which retains the another end portion 33*b* of the pigtail harness 33 is provided on a radially outer portion of the bending portion of each of the one-side terminals 31*a* and 31*a* (relative to an axis of the annular protruding portion 28*g*). Moreover, in the second embodiment, a structure of the guide portion is changed.

Figure 15:
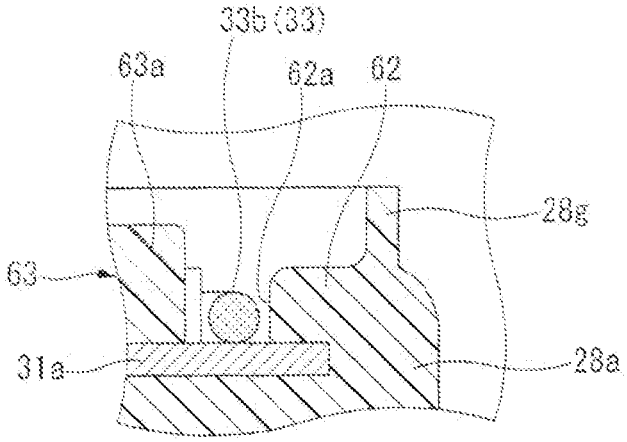
FIG. 15 is a sectional view of FIG. 14, taken along a line D-D.

As shown in FIG. 15, the retainer wall 62 is integrally formed with the brush retaining portion 28*a*, and covers an (radially) outside portion of the another end portion of the one-side terminal 31*a* to abut thereon. The retainer wall 62 is formed from a location facing an outside surface of a guide portion 63 (corresponding to the guide portion 63 of the first embodiment), to the another end portion of the one-side terminal 31*a*, i.e. toward the crimp contact 34. That is, an inside wall surface 62*a* of the retainer wall 62 is shaped like an arc in a region corresponding to the outside surface of the guide portion 63, and then extends linearly toward the crimp contact 34, so that a guide hole is formed between the inside wall surface 62*a* and (an outside surface 63*c* of) an after-mentioned base end portion 63*a* of the guide portion 63.

Figure 16:
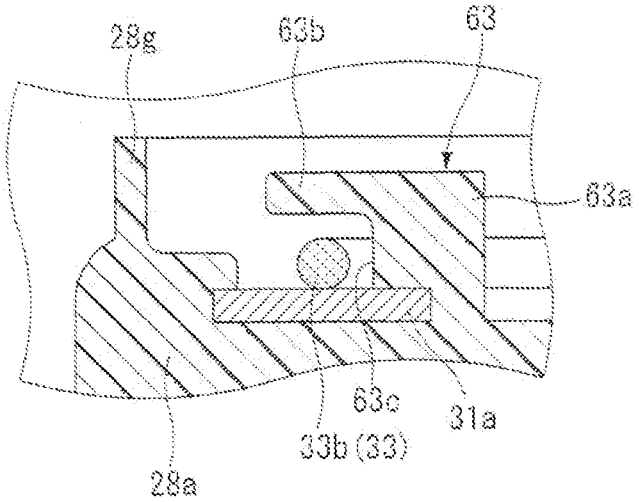
FIG. 16 is a sectional view of FIG. 14, taken along a line E-E.

As shown in FIG. 16, each guide portion 63 includes the base end portion 63*a* and a protruding piece 63*b*. The base end portion 63*a* is formed integrally with the bottom wall 28*f* of the brush retaining portion 28*a*. The protruding piece 63*b* is located at an upper end (top end) of the base end portion 63*a* and formed integrally with the upper end of the base end portion 63*a*.

The base end portion 63*a* is formed in a substantially cylindrical-column shape such that the outside surface 63*c* of the base end portion 63*a* is in a substantially arc-shape. On the other hand, the protruding piece 63*b* is in a flange shape (cap-brim shape), and outwardly extends in a direction substantially perpendicular to the one end portion of the one-side terminal 31*a*, i.e. extends substantially in parallel with the another end portion of the one-side terminal 31*a*. Hence, the pigtail harness 33 is located between the protruding piece 63*b* and the one-side terminal 31*a* with respect to the axial direction of the brush guide holder 29*a*, 29*b*.

Before the brush retaining portion 28*a* is attached to the cover member 3, the pigtail harness 33 is elastically in contact with the outside surface 63*c* of the base end portion 63*a* of the guide portion 63 so that the pigtail harness 33 is bent in the substantially dogleg shape (at obtuse angle) in the same manner as the first embodiment. After the brush retaining portion 28*a* was attached to the cover member 3, as shown in FIG. 14, the pigtail harness 33 is slightly deformed in a deflecting manner, and bent at a substantially right angle (90-degree angle) such that a bending portion of the pigtail harness 33 is away from (i.e. is not in contact with) the outside surface 63*c* as viewed in the axial direction of the brush guide holder 29*a*, 29*b*.

Moreover, an upwardly deflecting deformation of the pigtail harness 33 is restricted by a lower surface of the protruding piece 63*b* (with respect to the axial direction of the brush guide holder 29*a*, 29*b*). That is, a linear part of the one end portion 33*a* near a part bent along the guide portion 63 is restricted by the protruding piece 63*b* in its movement in the axial direction of the brush guide holder 29*a*, 29*b*. On the other hand, the another end portion 33*b* of the pigtail harness 33 is retained along the inside wall surface 62*a* of the retainer wall 62.

Accordingly, in the second embodiment, the shape of the another end portion 33*b* of the pigtail harness 33 is maintained by the inside wall surface 62*a* of the retainer wall 62, so that the another end portion 33*b* is kept in a substantially linear shape along the axis of the crimp contact 34. Hence, the concentrated stress between the crimp contact 34 and the end part 33*d* of the fixing portion 33*c* is effectively inhibited from occurring due to engine vibrations.

Moreover, the bending portion of the pigtail harness 33 which is bent along the base end portion 63*a* is limited in an upwardly bending and deflecting deformation by the protruding piece 63*b* of the guide portion 63 (as viewed in FIGS. 15 and 16). Accordingly, the retainer wall 62 reliably secures the linearity (parallelism) of the another end portion 33*b* relative to the axis of the crimp contact 34. Therefore, the concentrated stress to the end part 33*d* of the fixing portion 33*c* can be sufficiently suppressed.

The other configurations are the same as those of the first embodiment. Hence, of course, similar effects to the first embodiment are obtainable also in the second embodiment.

Although the invention has been described above with reference to certain embodiments of the invention, the invention is not limited to the embodiments described above. Modifications and variations of the embodiments described above will occur to those skilled in the art in light of the above teachings.

For example, a retaining groove for retaining the another end portion 33*b* of the pigtail harness 33 may be formed such that the another end portion 33*b* is fitted into the retaining groove.

Moreover, the opening 34*b* of the crimp contact 34 is formed by radially enlarging whole (inner and outer diameters) of the front end portion 34*a* of the crimp contact 34 in the above first and second embodiments. However, the opening 34*b* may be formed by cutting an inner circumferential portion of the front end portion 34*a* in a circular-cone shape i.e., by gradually enlarging only the inner diameter of the front end portion 34*a* to have a circular-cone-shaped inner circumferential surface of the front end portion 34*a*.

Moreover, the length L1 of the another end portion 33*b* may be set to be equal to, for example, 1.6 mm or 2.0 mm which is greater than 0.8 mm, as shown in FIG. 13. In such cases, the end part 33*d* of the fixing portion 33*c* is further inhibited from receiving the concentrated stress.

Moreover, the above-mentioned respective dimensions D, L, L1 and W can be changed arbitrarily according to a size and/or specifications of the valve-timing control apparatus and the like.

Moreover, the valve-timing control apparatus according to the present invention is applicable not only to the intake side of the internal combustion engine but also to an exhaust side of the internal combustion engine.

This application is based on prior Japanese Patent Application No. 2014-114472 filed on Jun. 3, 2014. The entire contents of this Japanese Patent Application are hereby incorporated by reference.

The scope of the invention is defined with reference to the following claims.

What is claimed is:

1. A valve-timing control apparatus for an internal combustion engine, wherein the valve-timing control apparatus is configured to vary a relative phase between a rotation of a cam shaft and a rotation of a crankshaft by energizing an electric motor through a power-feeding brush provided to be in contact with a slip ring, the valve-timing control apparatus comprising:

a retaining member slidably retaining the power-feeding brush;

a connector provided in the retaining member and connected to a power source;

a pigtail harness including one end portion connected with the power-feeding brush, and another end portion connected with a terminal of the connector through a fixing portion of the another end portion; and a guide portion provided in the retaining member and including an outer circumferential surface formed in an arc-shape, wherein the pigtail harness bends along the outer circumferential surface of the guide portion, and the another end portion extends substantially in a linear arrangement from the fixing portion to a bending portion at which the pigtail harness bends along the outer circumferential surface.

2. The valve-timing control apparatus according to claim 1, further comprising a connecting component formed of electrically conductive material in a substantially linear shape, the connecting component being fixed to the fixing portion of the pigtail harness and also to the terminal of the connector.

3. The valve-timing control apparatus according to claim 2, wherein the connecting component is a crimp contact which is crimped and fixed onto an outer circumference of the fixing portion.

4. The valve-timing control apparatus according to claim 3, wherein the crimp contact is bonded and fixed to the terminal of the connector by ultrasonic bonding.

5. The valve-timing control apparatus according to claim 3, wherein the crimp contact is in a substantially circular-tube shape, the fixing portion is inserted into the crimp contact from an axially one end opening of the crimp contact, and the crimp contact is crimped onto a part of the fixing portion which has a predetermined axial length from a tip of the fixing portion, but is not crimped onto a part of the fixing portion which is near the axially one end opening of the crimp contact.

6. The valve-timing control apparatus according to claim 5, wherein the axially one end opening of the crimp contact has a diameter gradually enlarged toward an edge of the crimp contact.

7. The valve-timing control apparatus according to claim 2, wherein the pigtail harness bends substantially in an L-shape along the outer circumferential surface of the guide portion.

8. The valve-timing control apparatus according to claim 2, wherein the another end portion of the pigtail harness is inserted into the connecting component from a front edge of the connecting component, and when an imaginary radial line of the guide portion extends perpendicularly to the another end portion of the pigtail harness from an axis of the guide portion, a distance between the front edge of the connecting component and the imaginary radial line is larger than or equal to 0.8 mm.

9. The valve-timing control apparatus according to claim 1, wherein the guide portion includes a base end portion substantially in the form of cylindrical column, and a protruding piece protruding at a top end of the base end portion, the pigtail harness bends along an outer circumferential surface of the base end portion, and the protruding piece covers a bending portion of the pigtail harness at which the pigtail harness bends along the outer circumferential surface of the base end portion.

10. The valve-timing control apparatus according to claim 1, wherein the valve-timing control apparatus further comprises a cover member covering a front end portion of a motor housing of the electric motor, the retaining member being configured to be attached to the cover member, the pigtail harness is elastically in contact with the outer circumferential surface of the guide portion by biasing force of a coil spring before the retaining member is attached to the cover member such that the power-feeding brush is in contact with the slip ring, and the pigtail harness is away from the outer circumferential surface of the guide portion when the retaining member is attached to the cover member such that the power-feeding brush is in contact with the slip ring by the biasing force of the coil spring.

11. The valve-timing control apparatus according to claim 1, wherein the retaining member includes a retaining hole in which the power-feeding brush is slidably retained, the terminal of the connector includes a harness insertion hole at a location corresponding to the retaining hole of the retaining member, and the one end portion of the pigtail harness passes through the harness insertion hole.

12. The valve-timing control apparatus according to claim 11, wherein the harness insertion hole includes a chamfered rounded surface located at an outside hole edge of the harness insertion hole.

13. The valve-timing control apparatus according to claim 12, wherein the rounded surface of the harness insertion hole has a curvature radius falling within a range from 0.1 mm to 0.5 mm.

14. A valve-timing control apparatus for an internal combustion engine, wherein the valve-timing control apparatus is configured to vary a relative phase between a rotation of a cam shaft and a rotation of a crankshaft by energizing an electric motor through a power-feeding brush provided to be in contact with a slip ring, the valve-timing control apparatus comprising:

a retaining member slidably retaining the power-feeding brush;

a connector provided in the retaining member and connected to a power source;

a conducting wire including one end portion connected with the power-feeding brush, and another end portion connected with a terminal of the connector through a fixing portion of the another end portion; and a guide portion provided in the retaining member and including an outer circumferential surface formed in an arc-shape, wherein the conducting wire bends at an obtuse angle around the outer circumferential surface of the guide portion, and the fixing portion is away by a predetermined distance from a bending portion at which the conducting wire bends around the outer circumferential surface.

15. The valve-timing control apparatus according to claim 14, wherein the valve-timing control apparatus further comprises a connecting component formed of electrically conductive material in a circular-tube shape, and the connecting component is fixed to the fixing portion of the another end portion of the conducting wire and also to the terminal of the connector.

16. The valve-timing control apparatus according to claim 15, wherein the another end portion extends along an axis of the connecting component from the bending portion to the fixing portion.

* * * * *